US010165382B2

(12) United States Patent
Aoki et al.

(10) Patent No.: US 10,165,382 B2
(45) Date of Patent: Dec. 25, 2018

(54) SIGNAL PROCESSING DEVICE, AUDIO SIGNAL TRANSFER METHOD, AND SIGNAL PROCESSING SYSTEM

(71) Applicant: YAMAHA CORPORATION, Hamamatsu-shi (JP)

(72) Inventors: Ryotaro Aoki, Hamamatsu (JP); Atsushi Usui, Hamamatsu (JP); Masaya Kano, Hamamatsu (JP); Kotaro Nakabayashi, Hamamatsu (JP); Yuta Yuyama, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/935,693

(22) Filed: Mar. 26, 2018

(65) Prior Publication Data

US 2018/0220249 A1 Aug. 2, 2018

Related U.S. Application Data

(63) Continuation of application No. PCT/JP2017/011155, filed on Mar. 21, 2017.

(30) Foreign Application Priority Data

Mar. 22, 2016 (JP) ..... 2016-056750
Mar. 22, 2016 (JP) ..... 2016-056751
Mar. 22, 2016 (JP) ..... 2016-056752

(51) Int. Cl.
*H04S 7/00* (2006.01)
*H04S 3/00* (2006.01)

(52) U.S. Cl.
CPC ..... *H04S 3/008* (2013.01); *H04S 7/30* (2013.01); *H04S 2400/03* (2013.01); *H04S 2400/07* (2013.01); *H04S 2400/13* (2013.01)

(58) Field of Classification Search
CPC ..... H04S 1/00
(Continued)

(56) References Cited

U.S. PATENT DOCUMENTS 6,226,616 B1 5/2001 You et al.
2006/0153389 A1* 7/2006 Temerinac ..... H04H 20/88 381/2

(Continued)

FOREIGN PATENT DOCUMENTS

JP 2003502704 A 1/2003
JP 2008028496 A 2/2008

(Continued)

OTHER PUBLICATIONS

International Search Report issued in Intl. Appln. No. PCT/JP2017/011155 dated Jun. 6, 2017. English translation provided.

(Continued)

*Primary Examiner* — Melur Ramakrishnaiah
(74) *Attorney, Agent, or Firm* — Rossi, Kimms & McDowell LLP

(57) ABSTRACT

A signal processing device includes a selector configured to select one of a plurality of methods, in accordance with which a signal generation process is performed for generating a transfer signal in which additional information is added to an audio signal; a signal processor configured to execute the signal generation process of adding the additional information to the audio signal in accordance with the method selected by the selector; and a transferrer configured to transfer to a reproduction device the transfer signal generated by the signal processor.

20 Claims, 16 Drawing Sheets

(58) Field of Classification Search
USPC ..... 381/303, 311, 1, 77, 74, 384
See application file for complete search history.

(56) References Cited

U.S. PATENT DOCUMENTS

| | | | | |
|---|---|---|---|---|
| 2010/0191355 | A1 | 7/2010 | Toba | |
| 2011/0052141 | A1* | 3/2011 | Takatsuji ..... | H04N 5/775 386/231 |
| 2011/0176056 | A1 | 7/2011 | Toba | |
| 2012/0128179 | A1 | 5/2012 | Kano et al. | |
| 2012/0141098 | A1 | 6/2012 | Aoki | |

FOREIGN PATENT DOCUMENTS

| | | | |
|---|---|---|---|
| JP | 2010119076 | A | 5/2010 |
| JP | 2010171768 | A | 8/2010 |
| JP | 2013174882 | A | 9/2013 |
| JP | 5531486 | B2 | 6/2014 |

OTHER PUBLICATIONS

Written Opinion issued in Intl. Appln. No. PCT/JP2017/011155 dated Jun. 6, 2017.

* cited by examiner

| SAMPLE NUMBER | SAMPLE VALUE (AMPLITUDE) |
|---|---|
| 0 | 0 |
| 1 | 0.707106781 |
| 2 | −1 |
| 3 | 0.707106781 |
| 4 | 3.67545E−16 |
| 5 | −0.707106781 |
| 6 | 1 |
| 7 | −0.707106781 |
| 8 | −7.35089E−16 |

FIG. 5

AMPLITUDE : 1.0

| SAMPLE NUMBER | AMPLITUDE BEFORE MULTIPLICATION | AMPLITUDE AFTER MULTIPLICATION |
|---|---|---|
| 0 | 0 | 0 |
| 1 | 0.707106781 | 0.5 |
| 2 | −1 | 1 |
| 3 | 0.707106781 | 0.5 |
| 4 | 3.67545E−16 | 1.35089E−31 |
| 5 | −0.707106781 | 0.5 |
| 6 | 1 | 1 |
| 7 | −0.707106781 | 0.5 |
| | TOTAL | 4 |

FIG. 6

AMPLITUDE: −0.3

| SAMPLE NUMBER | AMPLITUDE BEFORE MULTIPLICATION | AMPLITUDE AFTER MULTIPLICATION |
|---|---|---|
| 0 | 0 | 0 |
| 1 | −0.212132034 | −0.15 |
| 2 | 0.3 | −0.3 |
| 3 | −0.212132034 | −0.15 |
| 4 | −1.10263E−16 | −4.05267E−32 |
| 5 | 0.212132034 | −0.15 |
| 6 | −0.3 | −0.3 |
| 7 | 0.212132034 | −0.15 |
| | TOTAL | −1.2 |

| SAMPLE NUMBER | AMPLITUDE BEFORE AVERAGING | AFTER AVERAGING |
|---|---|---|
| 0 | 0 | −1.207106781 |
| 1 | 0.707106781 | 1.707106781 |
| 2 | −1 | −1.207106781 |
| 3 | 0.707106781 | −9.4369E−16 |
| 4 | 3.67545E−16 | 1.207106781 |
| 5 | −0.707106781 | −1.707106781 |
| 6 | 1 | 1.207106781 |
| 7 | −0.707106781 | 1.22125E−15 |
| 8 | −7.35089E−16 | −1.207106781 |

FIG. 8

AMPLITUDE: −1.0

| SAMPLE NUMBER | AMPLITUDE BEFORE MULTIPLICATION | AMPLITUDE AFTER MULTIPLICATION |
|---|---|---|
| 0 | −1.207106781 | 1.457106781 |
| 1 | 1.707106781 | 2.914213562 |
| 2 | −1.207106781 | 1.457106781 |
| 3 | −9.4369E−16 | 8.9055E−31 |
| 4 | 1.207106781 | 1.457106781 |
| 5 | −1.707106781 | 2.914213562 |
| 6 | 1.207106781 | 1.457106781 |
| 7 | 1.22125E−15 | 1.49144E−30 |
| | TOTAL | 11.65685425 |

FIG. 9

AMPLITUDE: −0.3

| SAMPLE NUMBER | AMPLITUDE BEFORE MULTIPLICATION | AMPLITUDE AFTER MULTIPLICATION |
|---|---|---|
| 0 | 0.362132034 | −0.437132034 |
| 1 | −0.512132034 | −0.874264069 |
| 2 | 0.362132034 | −0.437132034 |
| 3 | 2.83107E−16 | −2.67165E−31 |
| 4 | −0.362132034 | −0.437132034 |
| 5 | 0.512132034 | −0.874264069 |
| 6 | −0.3621232034 | −0.437132034 |
| 7 | −3.66374E−16 | −4.47432E−31 |
| | TOTAL | −3.497056275 |

FIG. 10

| SAMPLE NUMBER | AMPL. VALUE BEFORE MULTIPLICATION | SAMPLE POINTS (0-7) | SAMPLE POINTS (1-8) | SAMPLE POINTS (2-9) | SAMPLE POINTS (3-10) | SAMPLE POINTS (4-11) | SAMPLE POINTS (5-12) | SAMPLE POINTS (6-13) |
|---|---|---|---|---|---|---|---|---|
| 0 | -1.207106781 | 1.457106781 | | | | | | |
| 1 | 1.707106781 | 2.914213562 | -2.060660172 | | | | | |
| 2 | -1.207106781 | 1.457106781 | -2.060660172 | 1.457106781 | | | | |
| 3 | -9.4369E-16 | 8.9055E-31 | 1.13913E-15 | -1.61098E-15 | 1.13913E-15 | | | |
| 4 | 1.207106781 | 1.457106781 | -1.13913E-15 | -1.457106781 | 2.060660172 | -1.457106781 | | |
| 5 | -1.707106781 | 2.914213562 | -2.060660172 | 1.61098E-15 | 2.060660172 | -2.914213562 | 2.060660172 | |
| 6 | 1.207106781 | 1.457106781 | -2.060660172 | 1.457106781 | -1.13913E-15 | -1.457106781 | 2.060660172 | -1.457106781 |
| 7 | 1.22125E-15 | 1.49144E-30 | 1.47417E-15 | -2.0848E-15 | 1.47417E-15 | -1.15248E-30 | -1.47417E-15 | 2.0848E-15 |
| 8 | -1.207106781 | TOTAL 11.65685425 | -1.47417E-15 | -1.457106781 | 2.060660172 | -1.457106781 | 1.13913E-15 | 1.457106781 |
| 9 | 1.707106781 | | TOTAL -8.242640687 | 2.0848E-15 | 2.060660172 | -2.914213562 | 2.060660172 | -1.61098E-15 |
| 10 | -1.207106781 | | | TOTAL 8.63947E-17 | -1.47417E-15 | -1.457106781 | 2.060660172 | -1.457106781 |
| 11 | -9.4369E-16 | | | | TOTAL 8.242640687 | -1.15248E-30 | -1.13913E-15 | 1.61098E-15 |
| 12 | 1.207106781 | | | | | TOTAL -11.65685425 | 1.47417E-15 | 1.457106781 |
| 13 | -1.707106781 | | | | | | TOTAL 8.242640687 | -2.0848E-15 |
| 14 | 1.207106781 | | | | | | | TOTAL -8.63947E-17 |
| 15 | 1.22125E-15 | | | | | | | |
| 16 | -1.207106781 | | | | | | | |

FIG. 12A

DATA STRUCTURE INSIDE PACKET CORRESPONDING TO L CHANNEL

| ORIGINAL QUANTIZATION BITS | EXPANDED QUANTIZATION BITS |
|---|---|
| L CHANNEL AUDIO SIGNAL (16 bits) | ch1 HIGHER 8 bits |
| L CHANNEL AUDIO SIGNAL (16 bits) | ch2 HIGHER 8 bits |
| L CHANNEL AUDIO SIGNAL (16 bits) | ch3 HIGHER 8 bits |
| L CHANNEL AUDIO SIGNAL (16 bits) | ch4 HIGHER 8 bits |

0 bit 16 bits 24 bits

FIG. 12B

DATA STRUCTURE INSIDE PACKET CORRESPONDING TO R CHANNEL

| ORIGINAL QUANTIZATION BITS | EXPANDED QUANTIZATION BITS |
|---|---|
| R CHANNEL AUDIO SIGNAL (16 bits) | ch1 LOWER 8 bits |
| R CHANNEL AUDIO SIGNAL (16 bits) | ch2 LOWER 8 bits |
| R CHANNEL AUDIO SIGNAL (16 bits) | ch3 LOWER 8 bits |
| R CHANNEL AUDIO SIGNAL (16 bits) | ch4 LOWER 8 bits |

0 bit 16 bits 24 bits

FIG. 14

L CHANNEL (48kHz)

| | |
|---|---|
| FIRST SAMPLE | ORIGINAL SIGNAL 1 |
| SECOND SAMPLE | ORIGINAL SIGNAL 2 |
| THIRD SAMPLE | ORIGINAL SIGNAL 3 |
| FOURTH SAMPLE | ORIGINAL SIGNAL 4 |

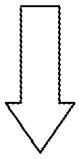

L CHANNEL (96kHz):
AFTER FREQUENCY EXPANSION

| | |
|---|---|
| FIRST SAMPLE | ORIGINAL SIGNAL 1 |
| SECOND SAMPLE | EMPTY SAMPLE 1 |
| THIRD SAMPLE | ORIGINAL SIGNAL 2 |
| FOURTH SAMPLE | EMPTY SAMPLE 2 |
| FIFTH SAMPLE | ORIGINAL SIGNAL 3 |
| SIXTH SAMPLE | EMPTY SAMPLE 3 |
| SEVENTH SAMPLE | ORIGINAL SIGNAL 4 |
| EIGHTH SAMPLE | EMPTY SAMPLE 4 |

FIG. 15

| CHANNEL NAME / OPERATION MODE | L | C | R | SL | SR | LFE |
|---|---|---|---|---|---|---|
| KARAOKE | 1.0 | **0.0** | 1.0 | 0.7 | 0.7 | 1.0 |
| FRONT PRIORITY MIXING | 1.0 | 1.0 | 1.0 | **0.5** | **0.5** | 1.0 |
| NOCTURNAL LISTENING MIXING | **0.7** | **1.4** | **0.7** | 0.7 | 0.7 | **0.3** |

SIGNAL PROCESSING DEVICE, AUDIO SIGNAL TRANSFER METHOD, AND SIGNAL PROCESSING SYSTEM

CROSS REFERENCE TO RELATED APPLICATIONS

This application is a Continuation Application of PCT Application No. PCT/JP2017/011155, filed Mar. 21, 2017, and is based on and claims priority from Japanese Patent Application No. 2016-056750, filed Mar. 22, 2016; Japanese Patent Application No. 2016-056751, filed Mar. 22, 2016; and Japanese Patent Application No. 2016-056752, filed Mar. 22, 2016, the entire contents of each of which are incorporated herein by reference.

BACKGROUND OF THE INVENTION

Field of the Invention

The present invention relates to a signal processing device, an audio signal transfer method, and a signal processing system.

Description of the Related Art

Conventionally, there is known in the art audio equipment that downmixes a multi-channel signal used for a film or the like, for example, a signal of 5.1 channel or the like to 2.1 channel, and transfers the 2.1 channel signal. Such audio equipment is of a type that includes an AV amplifier, capable of concurrently transmitting multiple audio signals by use of a single transmission path (for example, refer to Japanese Patent No. 5531486, etc.). The AV amplifier disclosed in Japanese Patent No. 5531486 is connected to each of a source device, a TV, and speakers. When concurrently outputting audio from the source device to the TV and to the speakers, the AV amplifier may for instance indicate to the source device a number of channels that the AV amplifier is capable of reproducing, and receive from the source device input of an audio signal corresponding to the indicated number of channels. For a TV capable of reproducing only a small number of channels, the AV amplifier outputs a downmixed audio signal. For speakers capable of reproducing a large number of channels, the AV amplifier outputs an audio signal without changing the number of channels contained in the signal.

In some cases, when audio equipment, such as an AV amplifier, transfers to a reproduction device an audio signal input from a source device, the audio equipment transfers the audio signal after additional information is added to the signal. In such cases, depending on a transfer method used for transferring the audio signal from the source to the reproduction device, the audio signal is on occasion not properly reproduced by the reproduction device.

SUMMARY OF THE INVENTION

The present invention has been made in consideration of the above circumstances, and an object thereof is to provide a technology by which a possibility is reduced of an audio signal that has additional information added thereto being improperly reproduced by a reproduction device.

In one aspect of the present invention, a signal processing device includes: a selector configured to select one of a plurality of methods, in accordance with which a signal generation process is performed for generating a transfer signal in which additional information is added to an audio signal; a signal processor configured to execute the signal generation process of adding the additional information to the audio signal in accordance with the method selected by the selector; and a transferrer configured to transfer to a reproduction device the transfer signal generated by the signal processor.

In another aspect, an audio signal transfer method includes: selecting, from among a plurality of methods, a method for a signal generation process for generating a transfer signal by adding additional information to an audio signal; generating the transfer signal by a signal generation process of the selected method; and transferring the generated transfer signal to a reproduction device.

In still another aspect, a signal processing system includes an electronic device (signal processing device) and a reproduction device, and the electronic device (signal processing device) includes: a selector configured to select one of a plurality of methods, in accordance with which a signal generation process is performed for generating a transfer signal in which additional information is added to an audio signal; a signal processor configured to execute the signal generation process of adding the additional information to the audio signal in accordance with the method selected by the selector; and a transferrer configured to transfer to a reproduction device the transfer signal generated by the signal processor.

BRIEF DESCRIPTION OF THE DRAWINGS

FIG. 5 is a diagram showing sample values of a modulated signal and sample values of a demodulated signal.

FIG. 6 is a diagram showing sample values of a modulated signal and sample values of a demodulated signal.

FIG. 8 is a diagram showing sample values of an averaged signal and sample values of a demodulated signal.

FIG. 9 is a diagram showing sample values of an averaged signal and sample values of a demodulated signal.

FIG. 10 is a diagram showing a total of eight sample values of a demodulated signal in a provisional sample range.

FIG. 12A is a diagram showing an example of a data structure of a packet in a case that a signal generation process in accordance with a bit expansion method is executed.

FIG. 12B is a diagram showing an example of a data structure of a packet in a case that a signal generation process in accordance with a bit expansion method is executed.

FIG. 14 is an explanatory diagram for explaining an example of a data structure of a packet in a case that a signal generation process in accordance with a sampling frequency expansion method is executed.

FIG. 15 is a table showing an example of relationships between operation modes of an AV amplifier 13 and gain values of audio signals of a plurality of channels transferred by the AV amplifier 13.

DESCRIPTION OF THE EMBODIMENTS

Figure 1:
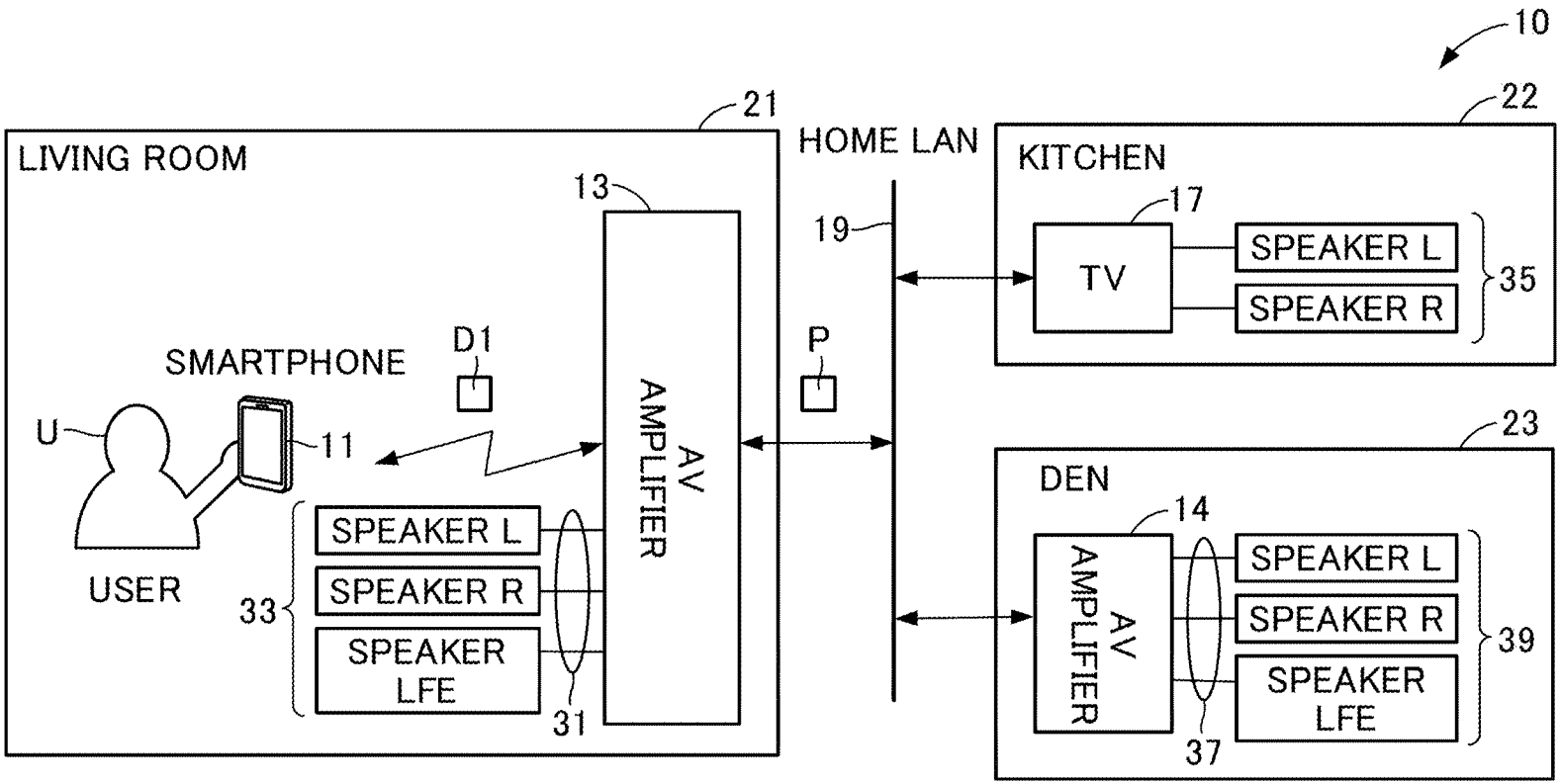
FIG. 1 is a diagram showing a network configuration of an AV system according to an embodiment.

An audio visual (AV) system 10 (an example of the "signal processing system") shown in FIG. 1 will be described below as an embodiment of the present invention. FIG. 1 shows an example of a network configuration of the AV system 10 of the present embodiment. In the AV system 10, a smartphone 11, a plurality of AV amplifiers 13 and 14, and a TV (television set) 17 are connected to a network 19. The network 19 is, for example, a home LAN (local area network) that interconnects the AV amplifiers 13 and 14 and the TV 17 disposed in a plurality of rooms (a living room 21, a kitchen 22, and a den 23) in a house. Although the present embodiment is described by way of an example in which the network 19 is a home LAN, the present invention is not limited thereto. The network 19 may be either a wired network or a wireless network. For example, the network 19 may be a wireless network compliant with Bluetooth (registered trademark), or may be a wireless network (wireless LAN) compliant with IEEE 802.11. The AV amplifiers 13 and 14, and the TV 17, for example, perform communication that is compliant with a prescribed network protocol, and transmit and receive via the network 19 a packet P that consists of header information and other information added to an audio signal. In the description below, the AV amplifiers 13 and 14, and the TV 17 connected to the network 19 in some cases are collectively referred to as "audio equipment".

An application program dedicated for controlling the AV amplifier 13, for example, is installed in the smartphone 11. A user U in the living room 21 controls the AV amplifier 13 by operating the smartphone 11. In the smartphone 11 various content is stored, such as music data, and the smartphone 11 functions as a source device for the AV system 10 of the present embodiment. The source device is not limited to the smartphone 11, and may for instance be a CD player or a personal computer, or a network storage, such as network-attached storage (NAS). Alternatively, the source device may be a music distribution server on the Internet. A file format of the music data may be, for example, MP3, WAV, Sound VQ (registered trademark), WMA (registered trademark), AAC, or the like.

The smartphone 11 can be connected to the AV amplifier 13 disposed in the living room 21 via wireless communication, for example. The user U operates the smartphone 11 to transmit designated content, such as 2.1 channel music data D1, to the AV amplifier 13. Bluetooth may for instance be employed as a standard of the wireless communication used by the smartphone 11. Alternatively, the smartphone 11 may use a wireless LAN of, for example, a Wi-Fi (registered trademark) standard to communicate with the AV amplifier 13 via a router, or the like, connected to the network 19.

The AV amplifier 13 in the living room 21 includes a terminal for connection to, for example, 2.1 channel speakers. An analog connection cable 31 connected to the terminal is connected to 2.1 channel speakers 33 disposed in the living room 21. The AV amplifier 13 reproduces from the speakers 33 the music data D1 received from the smartphone 11. The terminal of the AV amplifier 13 for connection to speakers is not limited to a terminal designed for a 2.1 channel system, and may be a terminal designed for, for example, a 5.1 channel system or a 7.1 channel system.

The AV amplifier 13 executes a process that causes the TV 17 or the AV amplifier 14 to reproduce the same music data D1 received from the smartphone 11. The AV amplifier 13 executes a signal processing (see FIG. 3) of converting the 2.1 channel music data D1 received from the smartphone 11 to music data D2 (for L channel) and music data D3 (for R channel). The AV amplifier 13 is capable of transferring a packet P including the music data D2 and D3 after conversion, to the TV 17 and the AV amplifier 14. Each of the music data D2 and D3 after conversion is data that has the same number of channels (2.1 channel) as the music data D1. Details will be described later.

The TV 17 disposed in the kitchen 22 receives the packet P including the music data D2 and D3 from the AV amplifier 13 via the network 19. The TV 17 includes built-in speakers 35 with two, left (L) and right (R) stereo channels. The TV 17 reproduces the music data D2 and D3 from the speakers 35.

The AV amplifier 14 in the den 23 includes a terminal designed for connection to, for example, 2.1 channel speakers. An analog connection cable 37 connected to this terminal is connected to 2.1 channel speakers 39 disposed in the den 23. The AV amplifier 14 receives from the AV amplifier 13 the packet P including the music data D2 and D3 via the network 19. The AV amplifier 14 reproduces the music data D2 and D3 from the speakers 39.

The music data D2 and D3 described above are obtained by converting the music data D1. In the present embodiment, in the living room 21, for example, the music data D1 is output from the 2.1 channel speakers 33. In the kitchen 22, for example, the music data D2 and D3 are output from the 2-channel speakers 35 of the TV 17 as stereo music, without modification. In the den 23, for example, the music data D1 is output from the 2.1 channel speakers 39.

Figure 2:
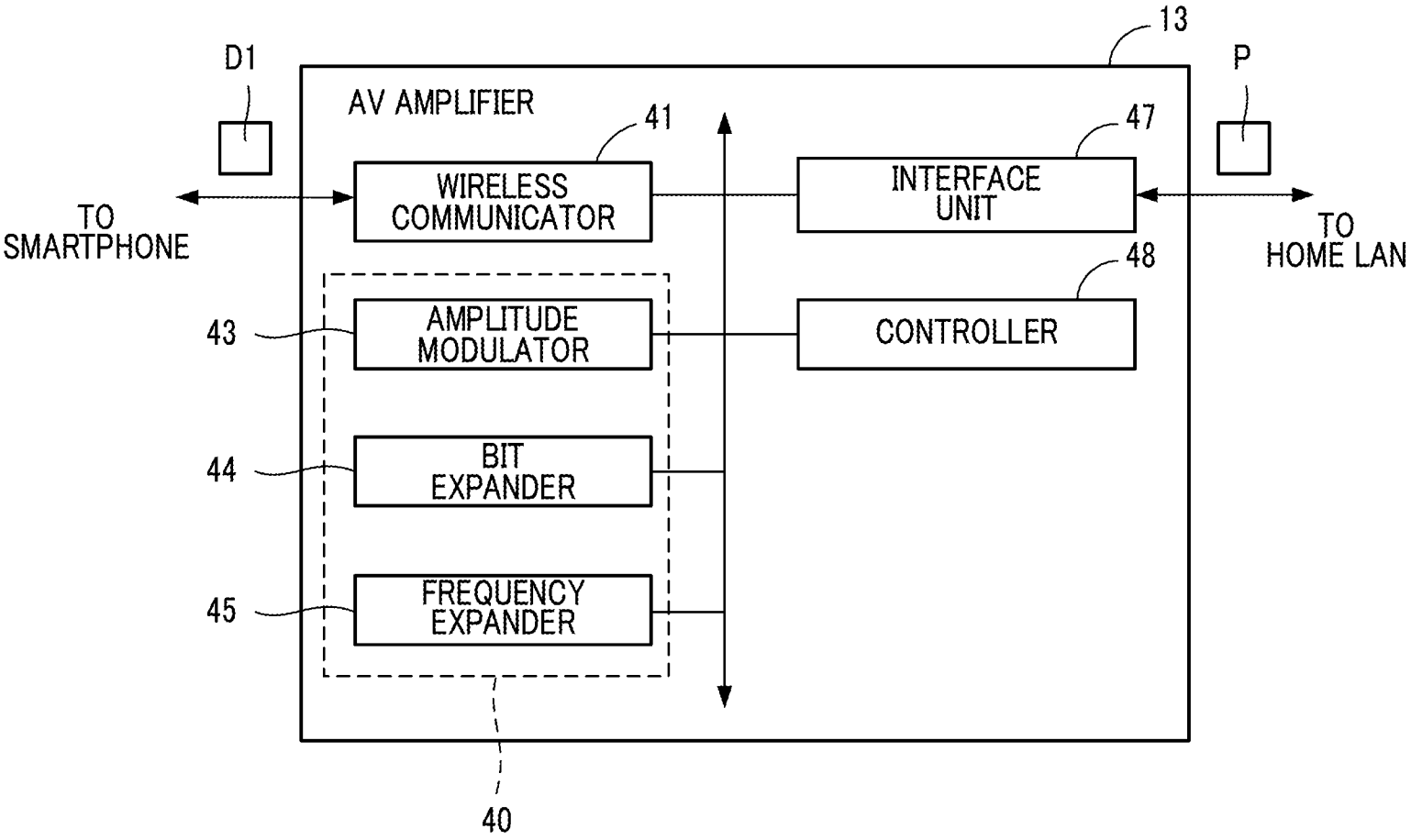
FIG. 2 is a block diagram showing a configuration of an AV amplifier in a living room.

FIG. 2 is a block diagram of a configuration of the AV amplifier 13 in the living room 21, and shows only a part of particular relevance to the present invention. As shown in FIG. 2, the AV amplifier 13 includes a signal processor 40, a wireless communicator 41, an interface unit 47, and a controller 48.

The wireless communicator 41 extracts the music data D1 from data received from the smartphone 11 by wireless communication. The music data D1 of the present embodiment includes, for example, a 2.1 channel audio signal in which a low frequency effect (LFE) channel audio signal dedicated for a low frequency range (an example of "a signal of a low frequency channel") is added to a stereo L (left)

channel audio signal and a stereo R (right) channel audio signal. In a case that the music data D1 does not include an LFE channel audio signal, low frequency components may be generated based on an audio signal including low frequency components extracted from the L channel audio signal and the R channel audio signal, and the generated low frequency components may serve as an LFE channel audio signal. The AV amplifier 13 of the present embodiment, for example, transfers 2-channel audio signals after including (adding) an LFE channel audio signal (an example of "additional information") in each of the signals.

The signal processor 40 executes a process of generating the music data D2 and D3 by including an LFE channel audio signal in each of the 2-channel audio signals of the L channel and the R channel (hereafter, this process may be referred to as a "signal generation process"). The music data D2 and D3 generated by the signal processor 40 are transmitted from the interface unit 47 to the network 19 in the form of a packet P. As shown in FIG. 2, in the present embodiment, the signal processor 40 includes an amplitude modulator 43, a bit expander 44, and a frequency expander 45. The amplitude modulator 43 executes a signal generation process by use of an amplitude modulation method. The bit expander 44 executes a signal generation process by use of a bit expansion method. The frequency expander 45 executes a signal generation process by use of a sampling frequency expansion method. In the description below, the amplitude modulation method, the bit expansion method, and the sampling frequency expansion method may be collectively referred to as a "transfer method". In short, the transfer method is an example of the "method for a signal generation process". The controller 48 is a device that centrally controls the AV amplifier 13. The controller 48 selects a module that executes the signal generation process from among the amplitude modulator 43, the bit expander 44, and the frequency expander 45. In other words, the controller 48 selects one transfer method from among the three transfer methods, i.e., the amplitude modulation method, the bit expansion method, and the sampling frequency expansion method. The controller 48 causes the signal generation process to be executed in accordance with the selected transfer method. The amplitude modulator 43, the bit expander 44, and the frequency expander 45 can be realized, for example, by use of a digital signal processor (DSP) designed to process audio upon execution of a prescribed program. Alternatively, the amplitude modulator 43, the bit expander 44, and the frequency expander 45 may be realized, for example, by way of analog circuits or by a CPU that executes a program.

Amplitude Modulation Method

Figure 3:
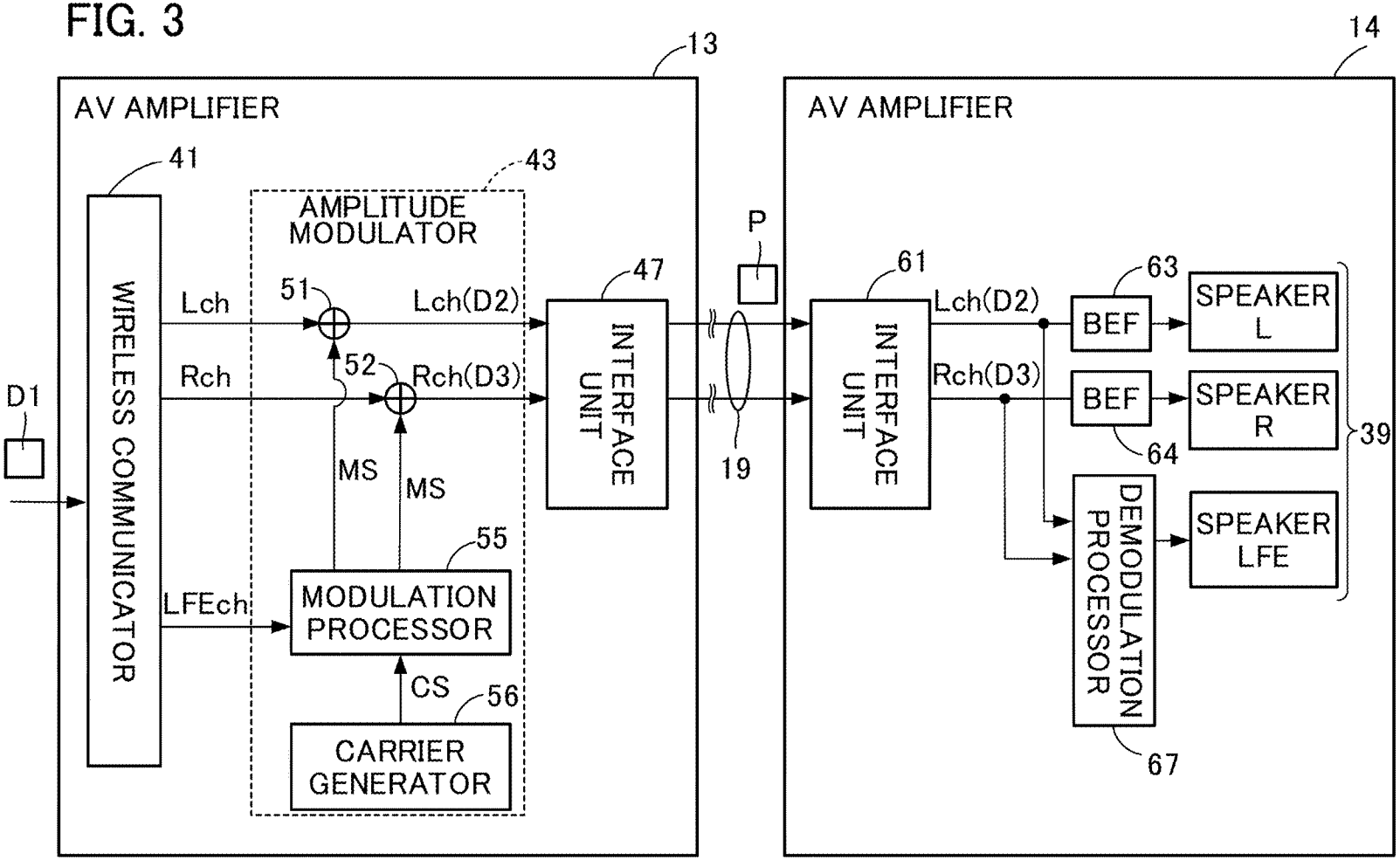
FIG. 3 is a block diagram showing a relationship of connections between the AV amplifier in the living room and an AV amplifier in a den.

The amplitude modulation method of the amplitude modulator 43 will be described first. FIG. 3 is a block diagram showing a relationship of connections between the AV amplifier 13 in the living room 21 and the AV amplifier 14 in the den 23. In this figure, only parts of the AV amplifier 13 relevant to the amplitude modulator 43 are shown. As shown in FIG. 3, the amplitude modulator 43 includes two adders 51 and 52, a modulation processor 55, and a carrier generator 56. The adder 51 corresponds to the L channel, and inputted to the adder 51 is the L channel audio signal among the audio signals extracted from the music data D1 by the wireless communicator 41. The adder 52 corresponds to the R channel, and inputted to the adder 52 is the R channel audio signal among the audio signals extracted from the music data D1 by the wireless communicator 41. The LFE channel audio signal is inputted to the modulation processor 55 from the wireless communicator 41. The L channel, R channel, and LFE channel audio signals are audio signals sampled at a sample rate of 48 kHz, for example.

Because the LFE channel audio signal here is a signal consisting of low frequency components only, the LFE channel audio signal can be reproduced as a natural sound even when the sampling frequency (i.e., sample rate) is set to be low. Accordingly, the modulation processor 55 downsamples the LFE channel audio signal. The carrier generator 56 outputs a carrier signal CS to the modulation processor 55. The modulation processor 55 uses a sample value of the downsampled LFE channel audio signal to amplitude modulate the carrier signal CS inputted from the carrier generator 56, and after modulation outputs the signal (hereafter, sometimes referred to as "modulated signal MS") to the adders 51 and 52.

More specifically, the carrier generator 56 outputs as the carrier signal CS a signal in a frequency band that is ordinarily barely audible to the human ear. Thus, 2-channel audio equipment (e.g., the TV 17) not compatible with multi-channel (2.1 channel) reproduction can directly reproduce the received music data D2 and D3 as stereo audio, whereby the audio data is reproduced with a natural 2-channel music sound.

As an example, a case will be described in which an LFE channel audio signal sampled at a sampling frequency (i.e., sample rate) of 48 kHz is downsampled to one-eighth of that of the original sampling frequency. In the present embodiment, in a case that the original signal is downsampled to one-eighth of its original sampling frequency, at least one piece of data used for amplitude modulation should be present for every eight samples of the original data. Accordingly, as a carrier signal CS there is used a signal having a frequency of 6 kHz (=48 kHz/8), and which has as one cycle, as many a number of cycles required to obtain eight samples at a frequency of 48 kHz (hereafter, referred to as "eight-sample cycle"). In addition, from among signals with frequencies equal to integer multiples of the frequency of 6 kHz, a signal in a band in which the signal is barely audible to the human ear is used as the carrier signal CS.

Examples of candidate signals for the carrier signal CS follow:

a signal having one cycle corresponding to the eight-sample cycle: 48 kHz/8 samples=6 kHz;

a signal having two cycles corresponding to the eight-sample cycle: (48 kHz/8 samples)·2=12 kHz; and a signal having three cycles corresponding to the eight-sample cycle: (48 kHz/8 samples)·3=18 kHz.

6 kHz and 12 kHz are within the audible frequency band, and it is highly probable that signals in these frequencies will act as noise during reproduction. For this reason, among the signals with frequencies equal to integer multiples of the frequency of 6 kHz, the signal having the frequency of 18 kHz, for example, can be used as the carrier signal CS, since the frequency of 18 kHz is within a frequency band that is barely audible during reproduction. In the present embodiment, the carrier signal CS will be a signal having one cycle corresponding to eight samples sampled within a span of three cycles of an 18 kHz sine wave.

Figures 4A, 4B:
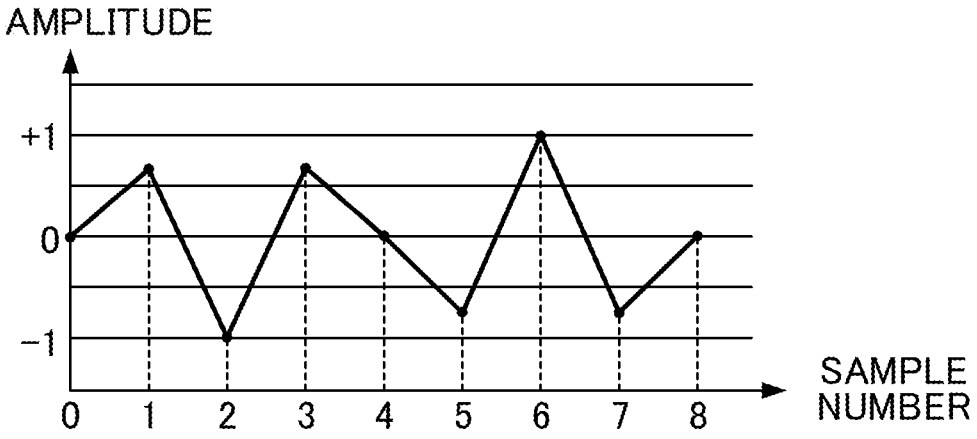
FIG. 4A is a diagram showing sample values of a carrier signal, where a magnitude of an amplitude of the carrier signal is "1".
FIG. 4B is a diagram showing a waveform of a carrier signal.

FIG. 4A shows a sample value of each of the eight samples sampled within a span of three cycles of an 18 kHz sine wave having a magnitude of an amplitude of "1". The sample value is a value of each of the eight samples in one cycle of the carrier signal CS. FIG. 4B shows a waveform for one cycle of the carrier signal CS. In the description below, sample values may be referred to as amplitude values of samples. The carrier generator 56 outputs the carrier signal CS shown in FIG. 4B to the modulation processor 55.

The modulation processor 55 uses the sample values (volume level) obtained by downsampling to one-eighth the LFE channel audio signal inputted from the wireless communicator 41, to amplitude modulate the carrier signal CS inputted from the carrier generator 56, and outputs the amplitude modulated signal to the adders 51 and 52. Being an audio signal of 18 kHz, this signal will be audio that is only slightly audible to human ears even if the signal were reproduced directly at the reproduction side.

As shown in FIG. 3, the adder 51 adds the modulated signal MS outputted from the modulation processor 55 to the L channel audio signal sampled at 48 kHz, and outputs the resulting signal to the interface unit 47 as the L channel audio signal (music data D2). Likewise, the adder 52 adds the modulated signal MS outputted from the modulation processor 55 to the R channel audio signal sampled at 48 kHz, and outputs the resulting signal to the interface unit 47 as the R channel audio signal (music data D3). The interface unit 47 packetizes the L channel music data D2 inputted from the adder 51 and the R channel music data D3 inputted from the adder 52, and transfers the music data D2 and D3 as a packet P to the AV amplifier 14 via the network 19.

The interface unit 61 of the AV amplifier 14 receives the packet P from the interface unit 47 of the AV amplifier 13. The interface unit 61 extracts from the received packet P the music data D2 corresponding to the L channel and the music data D3 corresponding to the R channel. The interface unit 61 outputs the music data D2 corresponding to the L channel to a band elimination filter (BEF) 63. The BEF 63 is a filter that, among signals in the music data D2 corresponding to the L channel, passes signals other than signals in a prescribed frequency band. The BEF 63 outputs, to the speaker 39 corresponding to the L channel, an audio signal obtained by removing unnecessary signal components for the L channel (such as 18 kHz amplitude modulated components) from the music data D2.

The interface unit 61 likewise outputs the music data D3 corresponding to the R channel to a BEF 64. The BEF 64 is a filter that, among signals in the music data D3 corresponding to the R channel, passes signals other than signals in a prescribed frequency band. The BEF 64 outputs an audio signal obtained by removing unnecessary signal components for the R channel (such as 18 kHz amplitude modulated components) from the music data D3 to the speaker 39 corresponding to the R channel.

The interface unit 61 outputs the music data D2 corresponding to the L channel and the music data D3 corresponding to the R channel to a demodulation processor 67. The demodulation processor 67, for example, downsamples to one-eighth the audio signals included in the received music data D2 and D3, and multiplies the one-eighth downsampled signals with an 18 kHz sine wave. Specifically, the demodulation processor 67 first downsamples to one-eighth the audio signals included in the music data D2 and D3 inputted into the demodulation processor 67, thereby extracting a plurality of sample values of the modulated signal MS. The demodulation processor 67 then multiplies the extracted modulated signal MS with the 18 kHz sine wave, thereby extracting amplitude values of the demodulated signal MD.

In FIG. 5, there is shown an example of the eight sample values of one cycle of the modulated signal MS (amplitudes before multiplication), and the eight sample values of the demodulated signal MD obtained by multiplying the eight sample values of the modulated signal MS with the 18 kHz sine wave (amplitudes after multiplication), where the amplitude value of the modulated signal MS is "1.0". In FIG. 6 there is shown another example of the eight sample values of one cycle of the modulated signal MS (amplitudes before multiplication) and the eight sample values of the demodulated signal MD obtained by multiplying the eight sample values of the modulated signal MS with the 18 kHz sine wave (amplitudes after multiplication), where the amplitude value of the modulated signal MS is "– 0.3". As shown in FIG. 5, the total "4" of the eight sample values of one cycle of the demodulated signal MD is four times the amplitude value "1" of the modulated signal MS. Likewise, as shown in FIG. 6, the total "–1.2" of the eight sample values of one cycle of the demodulated signal MD is four times the amplitude value "—0.3" of the modulated signal MS. That is, the total of the eight sample values of one cycle of the demodulated signal MD is four times the amplitude value of the modulated signal MS. As such, an amplitude value of the modulated signal MS can be extracted by multiplying the total of eight sample values of one cycle of the demodulated signal MD by ¼. Accordingly, the demodulation processor 67 corrects the plurality of sample values of the demodulated signal MD so that the amplitude of the demodulated signal MD will be ¼ of the total of the eight sample values of one cycle of the demodulated signal MD, and upsamples to eight times the demodulated signal MD after the correction, thereby demodulating the LFE channel audio signal. For the sake of convenience, in FIGS. 5 and 6 there are shown examples where the modulated signal MS and the carrier signal CS have the same waveforms.

In the amplitude modulating method described above, two problems exist as follows. First, the 18 kHz band signal originally included in each of the L channel audio signal and the R channel audio signal may cause noise in the amplitude modulated signal (modulated signal MS). In this regard, the demodulation processor 67 needs to extract only the modulated signal MS so as to prevent to as great an extent as possible influence from the original L channel audio signal and the original R channel audio signal. Second, since the adders 51 and 52 superpose the modulated signal MS on the L channel audio signal and the R channel audio signal, it is difficult to detect a start point of a cycle of the modulated signal MS in the demodulation processor 67. That is, it may be difficult to detect a sample value that serves as a reference for the modulated signal MS if the demodulation processor 67 attempts to multiply the plurality of sample values of the modulated signal MS with the 18 kHz sine wave after aligning the sample value serving as the reference from among the plurality of sample values of the modulated signal MS (e.g., the first sample value in a cycle of the modulated signal MS) with a reference point of the 18 kHz sine wave (e.g., a point at which the phase is "0"). Thus, a possibility exists that the demodulation processor 67 may multiply the plurality of sample values of the modulated signal MS with the 18 kHz sine wave without aligning the references. In this case, the LFE channel audio signal may not be accurately demodulated.

Removing In-Phase Components

Taking the foregoing into consideration, the amplitude modulator 43 of the AV amplifier 13, from which the signals are transferred (i.e., transfer source), adds the modulated signal MS to the L channel audio signal and the R channel audio signal according to rules described below. In a general music signal, it is highly probable that L channel and R channel signal components will include a large amount of in-phase components, such as vocal components. These in-phase components may be removed by, for example, subtracting the R channel audio signal from the L channel audio signal (Lch−Rch). For example, the adder 51 adds to the L channel audio signal the modulated signal MS as in-phase components, whereas the adder 52 adds to the R channel audio signal the modulated signal MS as reversed-phase components. Assuming that in-phase components included in a large amount in the L channel audio signal and the R channel audio signal are "C", and that components of the modulated signal MS are "D", the L channel audio signal and the R channel audio signal after addition of the modulated signal MS are expressed as follows:

$$Lch=C+D$$

$$Rch=C-D.$$

The demodulation processor 67 of the AV amplifier 14 of the transfer destination subtracts the R channel audio signal from the L channel audio signal (Lch−Rch) as expressed by equation (1) below.

$$Lch-Rch=(C+D)-(C-D)=2D \quad (1)$$

Accordingly, the demodulation processor 67 is able to remove the in-phase components C and extract only "D", which is the modulated signal MS. Moreover, since the signal "2D" extracted in equation (1) has an amplitude that is double the amplitude of the original signal "D", a sound-to-noise ratio (S/N ratio) is increased, which in turn reduces an influence of noise.

Calculating Average Value

An audio music signal may include a large amount of low frequency components and/or components of a human voice band (e.g., 1 kHz). In these low frequency components and components of a human voice band, waveform fluctuation for each sample is small. Accordingly, the demodulation processor 67 of the transfer destination removes original L channel and R channel signal components from each of the music data D2 and D3 transferred, by way of moving average value calculation corresponding to weighting of a plurality of samples in the music data D2 and D3 such that two consecutive samples cancel each other, as shown in the conversions below.

Sample number: value before conversion→value after conversion

First sample: $X \rightarrow X \cdot 0.5-(X+1)+(X+2) \cdot 0.5$

Second sample: $X+1 \rightarrow (X+1) \cdot 0.5-(X+2)+(X+3) \cdot 0.5$

Third sample: $X+2 \rightarrow (X+2) \cdot 0.5-(X+3)+(X+4) \cdot 0.5$

Fourth sample: $X+3 \rightarrow (X+3) \cdot 0.5-(X+4)+(X+5) \cdot 0.5$

⋮

Figures 7A, 7B:
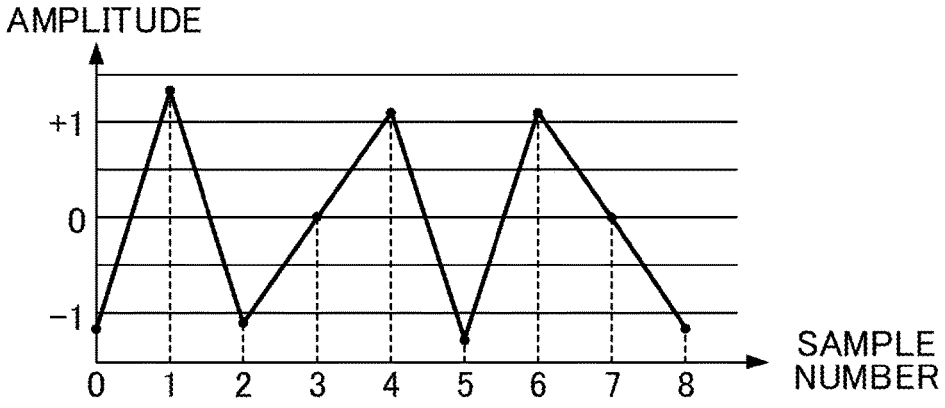
FIG. 7A is a diagram showing sample values of a modulated signal and sample values of an averaged signal.
FIG. 7B is a diagram showing a waveform of an averaged signal.

The demodulation processor 67, for example, converts the respective sample values of the monauralized signal D extracted in equation (1) above in accordance with the conversions above for weighting. In FIG. 7A there are shown relationships among the plurality of sample values of the modulated signal MS (amplitudes before averaging) shown in FIG. 5 and sample values after calculating moving averages of the plurality of sample values (after averaging). In FIG. 7B there is shown a waveform of a signal after calculating the moving averages on the modulated signal MS as described above (hereafter, referred to on occasion as "averaged signal MA"). The demodulation processor 67, for example, first calculates moving averages as described above, on the plurality of sample values of the modulated signal MS, thereby generating the averaged signal MA. Then, the demodulation processor 67 multiplies the averaged signal MA with the 18 kHz sine wave, thereby extracting the demodulated signal MD.

In FIG. 8, there is shown as an example the eight sample values of the averaged signal MA, obtained by performing a moving averaging operation on the plurality of sample values of the modulated signal MS (amplitudes before multiplication), and the eight sample values of the demodulated signal MD, which are obtained by multiplying the eight sample values of the averaged signal MA with the 18 kHz sine wave (amplitudes after multiplication). In this example, the amplitude value of the modulated signal MS is "1.0". In FIG. 9, there is shown as an example the eight sample values of the averaged signal MA, which are obtained by performing a moving averaging operation on the plurality of sample values of the modulated signal MS (amplitudes before multiplication) and the eight sample values of the demodulated signal MD obtained by multiplying the eight sample values of the averaged signal MA with the 18 kHz sine wave (amplitudes after multiplication). In this example, the amplitude value of the modulated signal MS is "−0.3". As shown in FIG. 8, the total "11.65685425" of the eight sample values corresponding to those of one cycle of the demodulated signal MD is about 11.6 times the amplitude value "1.0" of the modulated signal MS. Likewise, as shown in FIG. 9, the total "−3.497056275" of the eight sample values corresponding to those of one cycle of the demodulated signal MD is about 11.6 times the amplitude value "−0.3" of the modulated signal MS. Accordingly, when using a moving average value, the demodulation processor 67 corrects the plurality of sample values of the demodulated signal MD so that the amplitude of the demodulated signal MD will be "1/11.65685425" times the total of the sample values of one cycle of the demodulated signal MD, and upsamples to eight times the demodulated signal MD after the correction, thereby demodulating the LFE channel audio signal. In this way, the demodulation processor 67 removes L channel and R channel audio signal components from the music data D2 and D3 to reduce the influence from the original signals (the L channel audio signal and the R channel audio signal) affecting the modulated signal MS as noise components, thereby solving the above first problem.

Detecting Point in Amplitude Modulated Signal

In relation to the second problem mentioned above, detecting a start point of a cycle of the modulated signal MS is crucial. In the present embodiment, the waveform of the carrier signal CS is the same for each set of 8 samples. Thus, the waveform of the modulated signal MS is the same for each set of 8 samples, and the waveform of the averaged signal MA is also the same for each set of 8 samples. This being the case, the demodulation processor 67 of the present embodiment first specifies from among a plurality of samples of the averaged signal MA a provisional sample start point. Then, given that the first sample point corresponds to the provisional start point, the demodulation processor 67 specifies a range from the first sample point to the eighth sample point (i.e., a range corresponding to one cycle of the averaged signal MA) to be a provisional sample range. Subsequently, the demodulation processor 67, after aligning the provisional start point and the reference point of the 18 kHz sine wave, multiplies with the 18 kHz sine wave each of the sample values of the eight samples of the averaged signal MA in the provisional sample range, thereby calculating the sample value of each of the eight samples of the demodulated signal MD in the provisional sample range. The demodulation processor 67 then adds up the eight sample values of the demodulated signal MD in the provisional sample range. The demodulation processor 67, for example, repeats by eight times the above process of calculating the total of the eight sample values of the demodulated signal MD in the provisional sample range by shifting the provisional start point one-by-one. The demodulation processor 67 determines, as a sample start point (a sample point corresponding to the sample value serving as a reference), a provisional start point corresponding to the greatest value in terms of the absolute value of the total of the eight sample values of the demodulated signal MD in the corresponding provisional sample range.

In the diagram in FIG. 10, there are shown the eight sample values of the demodulated signal MD in the provisional sample range, and the total of the eight sample values for respective cases, in which the provisional start point is shifted one-by-one from "0" to "6". In FIG. 10, and similar to FIG. 8, an example case is assumed where the amplitude value of the modulated signal MS is "1.0". In FIG. 10, there is shown an example where it is assumed that the sample point "0" is the reference point of the 18 kHz sine wave (e.g., the start point of the waveform of the 18 kHz sine wave). As shown in FIG. 10, in a case that the provisional sample range is "0-7", i.e., in a case that the provisional start point corresponds to "0" that is the reference point of the 18 kHz sine wave, the absolute value of the total of the eight sample values of the demodulated signal MD in the provisional sample range is 11.65685425, which is the greatest value. Meanwhile, in a case that the provisional sample range is "1-8" and the provisional start point "1" does not correspond to "0", which is the reference point of the 18 kHz sine wave, the absolute value of the total of the eight sample values of the demodulated signal MD in the provisional sample range is 8.242640687, which is smaller than the greatest value (11.65685425). The demodulation processor 67 sets, as the sample start point, the provisional start point at which the absolute value of the total of the eight sample values of the demodulated signal MD in the provisional sample range is the greatest. The demodulation processor 67 can then appropriately set a sample point for multiplying the music data D2 and D3 or the monauralized signal D with the sine wave.

It is of note that, as shown in FIG. 10, the absolute value of the total of the eight sample values of the demodulated signal MD in the provisional sample range is the greatest (11.65685425) also when the provisional sample range is "4-11". In the present embodiment, the LFE signal subject to amplitude modulation consists of low frequency components and a difference between two adjacent samples is small. Therefore, an error in the LFE signal after multiplication with the sine wave is performed is small in both cases of the sample point "0" being set as the start point and the sample point "4" being set as the start point. Furthermore, if, for example, the original signal before amplitude modulation is set to a positive value, a greatest value that is positive can be detected as the start point. More specifically, the modulation processor 55 of the transfer source performs calculation of "(sample value)·0.5+0.5" on a carrier signal CS having sample values within the range "−1.0 to +1.0", thereby rendering the entire waveform of the carrier signal CS into positive values. The demodulation processor 67 of the transfer destination sets, as the sample start point, a provisional start point at which the total of the eight sample values of the demodulated signal MD in the provisional sample range takes the greatest positive value. The demodulation processor 67 then performs calculation of "(sample value −0.5)·2.0" on each of the values of the demodulated signal MD for inverse conversion. In this way, the demodulation processor 67 can extract the LFE channel signal.

Upsampling

In the description above, a case is described in which the modulation processor 55 amplitude modulates a carrier signal CS generated based on an 18 kHz sine wave, but the present invention is not limited thereto. For example, the modulation processor 55 may amplitude modulate the LFE channel audio signal using a carrier signal CS in a frequency band higher than the audible frequency band, and add the obtained signal to the L channel audio signal and the R channel audio signal.

If it is possible to upsample the L channel audio signal and the R channel audio signal sampled at 48 kHz to 192 kHz, which is four times, a signal with a frequency higher than the audible frequency band (e.g., 72 kHz=24 kHz·3) may be employed as the carrier signal CS among signals that have an eight-sample cycle at 192 kHz (each signal having a frequency of an integer multiple of 24 kHz (=192 kHz/8)), and this carrier signal CS can be amplitude modulated with the LFE channel audio signal downsampled to one-eighth. In this case, if the music data D1 does not include high frequency components, such as 192 kHz components, the signals included in the music data D1 will not include noise. Furthermore, it becomes possible to separate a channel by merely using a high-pass filter or a low-pass filter without performing the above subtraction (Lch−Rch) or calculating moving averages. Moreover, if, for example, a plurality of adjacent frequencies in a high frequency band can be used as the carrier signal CS, a multi-channel audio signal, such as a 5.1 channel audio signal, can be amplitude modulated using this carrier signal CS and transferred within the high frequency band.

Bit Expansion Method

Next, a bit expansion method of the bit expander 44 (see FIG. 2) will be described. The bit expander 44 uses an empty area among quantization bits of the audio signal such that a plurality of channel signals are mixed therein and transferred. Music content of a compact disc (CD), for example, is usually quantized at a depth of 16 bits. In a case that a 16-bit quantized L channel audio signal and R channel audio signal are expanded to 24-bits each and transferred, a value "0" is set to the smallest eight bits. Accordingly, the bit expander 44, when expanding each of the 16-bit quantized L channel audio signal and R channel audio signal to 24-bits, uses the smallest eight bits to transfer audio signals of other channels than the L channel and R channel. A volume (sound pressure level) for the smallest eight bits is relatively low. Thus, even if the audio signals of other channels are set and reproduced directly as a 24-bit audio without being modified, since these audio signals are included in a volume range barely audible to the human ear, it is possible to reproduce at the transfer destination a sound that is not readily perceptible as unnatural.

Figure 11:
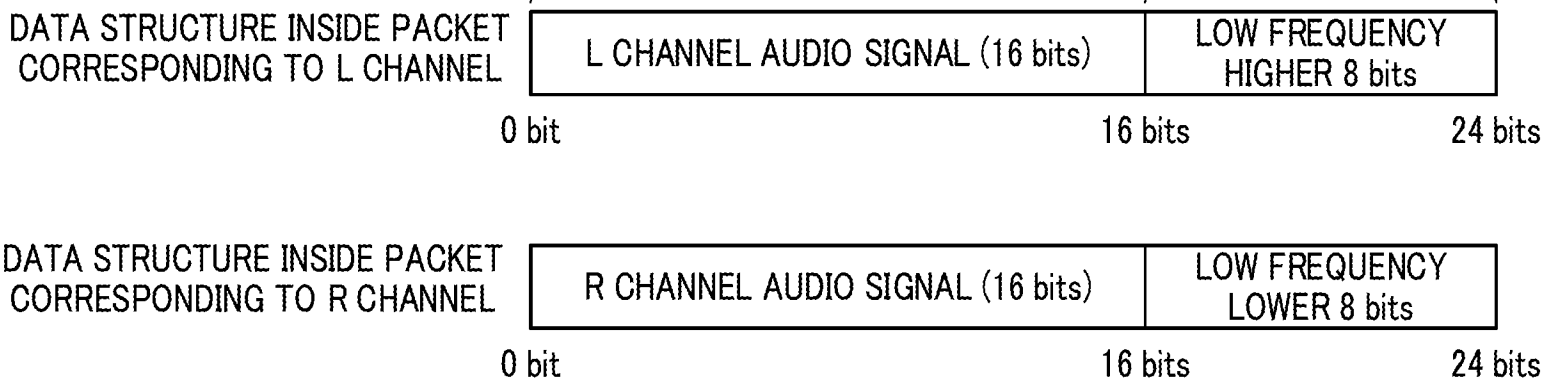
FIG. 11 is a diagram showing an example of a data structure of a packet in a case that a signal generation process in accordance with a bit expansion method is executed.

FIG. 11 shows an example of a data structure of the packet P transferred in the network 19. The data structure shown as an example is one that has undergone bit expansion. The bit expander 44 performs expansion on each of the 16-bit quantized L channel audio signal and R channel audio signal included in the audio signals extracted by the wireless communicator 41 (see FIG. 2) from the music data D1, so that the L channel audio signal and the R channel audio signal each can be transferred in a 24-bit format. The bit expander 44 adds and transfers, for example, an LFE channel audio signal in the smallest eight-bit data area increased when expansion is carried out from 16-bits to 24-bits. Specifically, in a case that the LFE channel audio signal is 16-bit quantized, the bit expander 44 sets the higher eight bits of the LFE channel audio signal in the expanded area of the L channel audio signal as shown in FIG. 11, and outputs the resulting L channel audio signal to the interface unit 47 as music data D2. The bit expander 44 allocates the lower eight bits of the LFE channel audio signal to the expanded area of the R channel audio signal, and outputs the resulting R channel audio signal to the interface unit 47 as music data D3. The interface unit 47, for example, packetizes and transfers the music data D2 and D3 in one packet P.

The destination audio equipment performs processes depending on a number of usable channels. For the TV 17 with the built-in 2-channel speakers 35, for example, bit values of the expanded area in each of the L channel audio signal and the R channel audio signal extracted from the packet P is cleared to zero and the resulting signals are output to the speakers 35. In other words, audio equipment, such as the TV 17, includes a "nullifier" that clears bit values of expanded area of audio signals to zero and a "reproducer" that reproduces the audio signals after nullification. Alternatively, the TV 17 sets a dither signal (uncorrelated noise) for the bit values of the expanded area in the audio signals, and outputs the resulting audio signals to the speakers 35. As a result, the speakers 35 are enabled to reproduce the L channel and R channel audios included in the music data D2 and D3. Even if the TV 17 is not compatible with the above described nullification of the expanded area, an influence of the signals acting as noise is likely to be extremely small even when the signals corresponding to the smallest eight bits are directly reproduced without being modified, because, as described above, the smallest eight bits of the 24 bits correspond to a volume range barely audible to the human ear.

The AV amplifier 14 connected to the 2.1 channel speakers 39 for example extracts the higher eight bits and the lower eight bits of the LFE channel audio signal from the packet P as a process for reproducing the LFE channel audio signal. The AV amplifier 14 synthesizes the extracted higher eight bits and lower eight bits of the LFE channel audio signal, and generates an LFE channel audio signal that is a 16-bit quantized, low frequency audio signal. The AV amplifier 14 outputs the generated LFE channel audio signal to the speakers 39. In other words, audio equipment, such as the AV amplifier 14, includes an "additional information acquirer" that extracts the higher eight bits and the lower eight bits of an LFE channel audio signal and an "outputter" that outputs the extracted LFE channel audio signal. As a process for reproducing the L channel audio signal and the R channel audio signal, the AV amplifier 14 (similarly to the TV 17) for instance clears to zero the expanded area of each of the L channel audio signal and the R channel audio signal extracted from the packet P, and outputs the resulting signals to the speakers 39. In this bit expansion method, audio signals of a plurality of channels can be included in a single packet P and, moreover, the audio signals can be included in one same packet P and transferred while having the same number of samples. Thus, sound output timings of the channels can be matched with each other easily.

Application of Bit Expansion Method

Description will be next given of a case in which upsampling is performed using the above bit expansion method. The bit expander 44 expands the above expanded area (empty area) by increasing the sampling frequency (i.e., sample rate) and mixes other signals into the expanded area, whereby audio signals of a larger number of channels can be transferred at the same time. An example case will be described in which each of an L channel audio signal and an R channel audio signal sampled at 48 kHz are upsampled to 192 kHz.

FIG. 12A shows a state in which an upsampled L channel audio signal has been expanded from 16-bits to 24-bits, and an audio signal of another channel is set in the expanded area. FIG. 12B shows a state in which an upsampled R channel audio signal has been expanded from 16-bits to 24-bits, and an audio signal of another channel is set in the expanded area. As shown in FIGS. 12A and 12B, the data amount of a signal upsampled to 192 kHz is four times that of the original 48 kHz signal. Accordingly, the data area of the expanded quantization bits also becomes four times. When for instance an audio signal of another channel sampled at 48 kHz and 16-bit quantized is set to the quadrupled expanded area, it is possible to allocate an audio signal of another channel in each of the four samples. In other words, it is possible to set four kinds of 16-bit quantized signals of other channels in the expanded area.

In the examples shown in FIGS. 12A and 12B, the higher eight bits and the lower eight bits of an audio signal of another channel (ch1 in the figures) are respectively set in the expanded area of the first L channel and the expanded area of the first R channel from the top (first samples). Likewise, the higher eight bits and the lower eight bits of audio signals of ch2, ch3, and ch4 are respectively set in the expanded area of the second and subsequent L channels and R channels (second and subsequent samples). In this case, a total of six channels (i.e., the two channels of the original L channel and R channel plus the four channels in the expanded area) can be transferred. As a process to be executed at the transfer destination, it is necessary to match sampling frequencies. For example, the AV amplifier 14 of the transfer destination matches sampling frequencies by either upsampling from 48 kHz to 192 kHz the audio signals of the channels ch1 to ch4 or the like signals in the expanded area or downsampling from 192 kHz to 48 kHz each of the L channel audio signal and the R channel audio signal.

Figure 13A:
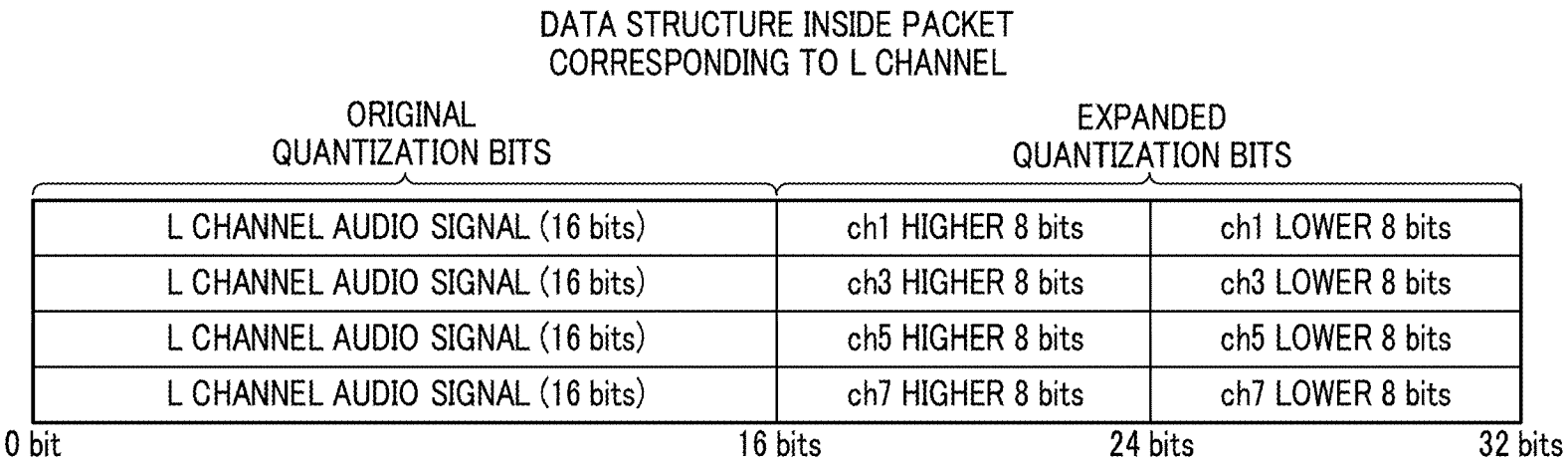
FIG. 13A is a diagram showing an example of a data structure of a packet in a case that a signal generation process in accordance with a bit expansion method is executed.
Figure 13B:
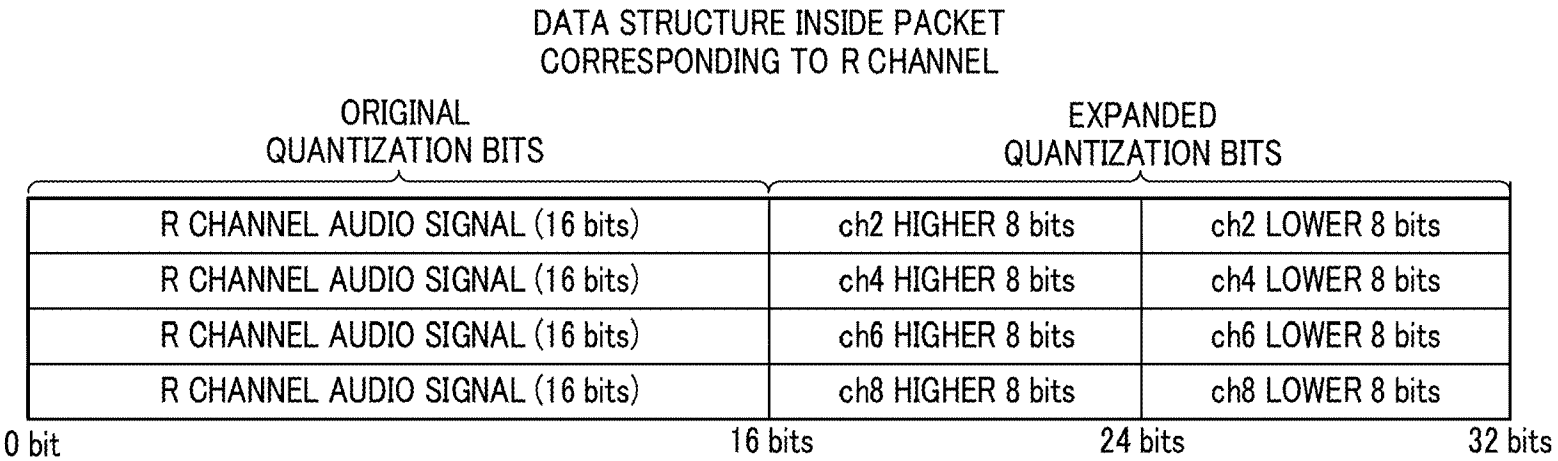
FIG. 13B is a diagram showing an example of a data structure of a packet in a case that a signal generation process in accordance with a bit expansion method is executed.

In a case where, for example, a 16-bit quantized signal can be expanded to 24-bits or greater (e.g., 32-bits), audio signals of an even greater number of channels can be mixed and transferred. FIGS. 13A and 13B show data structures of a packet Pin a case that the L channel audio signal and the R channel audio signal are expanded to 32-bits. In this case, it is possible to acquire data area of 16 bits (between the 16th bit and the 32nd bit) in the expanded area of each of the L channel audio signal and the R channel audio signal. As shown in FIGS. 13A and 13B, both higher bits and lower bits (16 bits) of an audio signal of a channel (ch1) other than the L channel and the R channel are set in the expanded area of the first L channel from the top. Similarly, both higher bits and lower bits (16 bits) of an audio signal of ch2 are set in the expanded area of the first R channel from the top. In this case, a total of ten channels consisting of the eight channels in the expanded area added to the two channels of the original L channel and R channel can be transferred. The bit expander 44 thus can expand the number of bits and thereby to increase the number of channels to be set in the expanded area.

Sampling Frequency Expansion Method

Next, the sampling frequency expansion method used by the frequency expander 45 (see FIG. 2) will be described. The frequency expander 45 acquires empty areas between data pieces by increasing the sampling frequency (i.e., sample rate), and mixes and transfers a plurality of channel signals by using the acquired empty areas. For example, in a case that the sampling frequencies of the L channel audio signal and the R channel audio signal are 48 kHz, the frequency expander 45 increases the sampling frequencies to double, which is 96 kHz. In ordinary upsampling, sample values obtained by newly sampling the original signal are set for the increased samples. The frequency expander 45 of the present embodiment, however, keeps the 48 kHz data unchanged without resampling, and for the portion of the increased samples, sets data differing from the data of the original audio signal. Accordingly, the L channel audio signal and the R channel audio signal can be mixed with signals of different channels or the like signals.

In FIG. 14 data is shown for each sample in the L channel audio signal both before (48 kHz) and after (96 kHz) the sampling frequency is increased. As shown in FIG. 14, the frequency expander 45 increases the sampling frequency from 48 kHz to 96 kHz, which is two times, and acquires "empty samples 1 to 4" between the samples. The frequency expander 45 embeds data of other channels (e.g., LFE channel) than the L channel and the R channel in the empty samples 1 to 4, whereby the frequency expander 45 is enabled to transfer, as signal data, channels of twice as many. While in FIG. 14 only the L channel audio signal is shown, substantially the same process can be performed on the R channel audio signal to enable transfer of twice as many channels.

In the case shown in FIG. 14, for each of the L channel audio signal and the R channel audio signal, empty areas corresponding to one channel can be acquired as data areas for setting the audio signal sampled at 48 kHz. Accordingly, the frequency expander 45 is enabled to transfer data corresponding to a total of four channels consisting of a channel each of the L channel and the R channel (two channels) and the additional two channels. The AV amplifier 14 of the transfer destination, for example, extracts data of a different channel for every other sample from the packet P, thereby to acquire each channel individually.

In the sample frequency expansion method described above, the sampling frequency is increased only during transfer. The AV amplifier 14 can reproduce the original 2.1 channel music data D1 by simply reverting the sampling frequency of the acquired data from 96 kHz to the original 48 kHz without resampling. Moreover, in the sampling frequency expansion method, unlike the ordinary upsampling, data pieces of multiple channels transferred are allocated to different samples. Accordingly, in the sampling frequency expansion method, audio signals of a plurality of channels are transferred together at one time but in separate samples. Hence, higher transfer rates and sound quality can be obtained as compared to the above amplitude modulation method or the bit expansion method.

Transmitting Metadata

In the above examples, an LFE channel audio signal is mixed in into each of an L channel audio signal and an R channel audio signal and the resulting signals are transferred in the three transfer methods, namely the amplitude modulation method, the bit expansion method, and the sampling frequency expansion method. The data that may be subject to mixing is not limited to an audio signal, but metadata (text data, control data, etc.,) may be used. For example, the AV amplifier 13 may transfer control data for gain modification as control data to be mixed. In an audio signal process in general, a process of reserving a headroom margin is required as a pre-process before performing a process in a digital domain by a DSP or the like. Then, a process of removing the headroom margin is required as a pre-process before reproduction in an analog domain. For example, for a 0 dB-full-scale LFE channel audio signal, the AV amplifier 13 performs a pre-process of reserving a headroom margin of −10 dB to prevent occurrence of clipping in the digital domain. The AV amplifier 13 transmits, as control data, data indicating an amount of the headroom margin (−10 dB) attenuated in advance in the digital domain, to the transfer destination audio equipment (e.g., a subwoofer designed to reproduce only the LFE channel). The subwoofer at the transfer destination amplifies the LFE channel audio signal by +10 bB in a process in the analog domain according to the control data. As a result, it is possible to match a signal level of the LFE channel audio signal with signal levels of the L channel audio signal and the R channel audio signal and thus reproduce the signals. Accordingly, occurrence of clipping in a process in the digital domain can be prevented and signal transfer with a higher sound quality is enabled. In the audio equipment of the present embodiment, as described above, control data or other metadata can be transmitted in addition to or in place of audio signals of a plurality channels.

According to a request from the user U, the AV amplifier 13 may mix and transfer control data for gain adjustment of a certain channel, and modify a reproduction state at the transfer destination. The example table in FIG. 15 shows relationships between a plurality of operation modes of the AV amplifier 13 and gain values of audio signals of a plurality of channels transferred by the AV amplifier 13. For example, the AV amplifier 13 sets, as control data, gain values that accord with the operation modes shown in FIG. 15; and using the transfer methods described above, mixes the control data into a 5.1-channel, multi-channel audio signal and transfers the resulting signal. The transfer destination audio equipment, for example, downmixes the received 5.1 channel audio signal to a 2-channel audio signal and reproduces the same. The audio equipment at the transfer destination increases or decreases the signal levels of the respective channels according to gain values set in the control data, and realizes reproduction that accords with each operation mode.

As shown in FIG. 15, a gain value for each channel is set in the control data. The channel names "L", "C", "R", "SL", "SR", and "LFE" in FIG. 15 indicate left, center, right, surround left, and surround right channels, and a channel dedicated for low frequency band, respectively. The gain value "1.0 times (attenuation amount 0 dB)" is a signal level for normal music reproduction.

In a case that the operation mode of the AV amplifier 13 is in karaoke mode, the audio equipment at the destination downmixes the signal by muting "0 times (attenuation amount −∞dB)" the center channel (C channel) containing a large amount of vocal components, thereby suppressing audio of a vocalist and reproducing a karaoke-like sound (see the bold-lined part in FIG. 15). The gain values of the surround channels SL and SR are "0.7 times (attenuation amount −3 dB), as shown in FIG. 15. This is because in the process of downmixing from 5.1 channel to 2 channel, the gain values of the surround channels SL and SR have to be multiplied by 0.7 times (attenuation amount −3 dB) in view of level adjustment, for example.

When the operation mode of the AV amplifier 13 is in front priority mixing mode, the transfer destination audio equipment downmixes the front channels (L, C, and R channels) in the normal way ("1 times (attenuation amount 0 dB)") while reducing the surround channels (SL and SR channels) "0.5 times (attenuation amount −6 dB)" (see the bold-lined part in FIG. 15). Accordingly, a sound reproduced and output from the audio equipment at the transfer destination is a sound in which surround audios containing a large amount of audience voice, etc., are suppressed while front audios are made more easily heard by emphasizing components of a singing voice of a vocalist, performance sound of a performer, etc.

When the operation mode of the AV amplifier 13 is in nocturnal listening mixing mode, the audio equipment at the transfer destination decreases the signal levels of the L, R, and LFE channels containing a large amount of loud-volume signals or low frequency components while increasing the signal level of the C channel containing a large amount of components of the singing voice of the vocalist (refer to the bold-lined part in FIG. 15). For example, the audio equipment at the transfer destination multiplies the signal levels of the L channel and the R channel by 0.7 times, multiplies the signal level of the LFE channel by 0.3 times, and multiplies the signal level of the C channel by 1.4 times. In the nocturnal listening mixing mode, accordingly, even when music is played for example at night at a low volume level, the human voice is made more audible by increasing the signal level of the C channel while the low frequency components are suppressed so that disturbance to neighbors by vibration, etc., accompanied by music playback can be suppressed.

As described above, sound at the destination can be matched with preferences of the user U by adjusting the signal levels of the channels using control data (metadata). The operation modes can be switched or set by, for example, the user U operating a remote controller of the AV amplifier 13 or operating an operation button provided on the AV amplifier 13. Alternatively, the controller 48 (see FIG. 2) of the AV amplifier 13 may for instance include in a memory, etc., a data table in which the gain values in the table shown in FIG. 15 are set in advance, and by referring to the data table, may set as control data signal levels that accord with each operation mode.

The AV amplifier 13 may also set as metadata a timestamp indicative of a playback time point of the music data D1 and mix the timestamp into each of the L channel audio signal and the R channel audio signal. Accordingly, timings of sound output can be matched between the transfer source and the transfer destination.

Transferring Downmixed Audio Signal

The respective transfer methods described above may be used not only to transfer ordinary 2-channel audio signals but also to transfer 2-channel signals into which conventionally used multi-channel signals have been downmixed. For example, the AV amplifier 13 may use any of the above transfer methods to mix a 5.1 channel signal into L channel audio signal and R channel audio signal downmixed to 2 channels and transfer the resulting signals. In this case, if the audio equipment at the transfer destination is a stereo speaker, the speaker can reproduce the downmixed 2-channel audio signals. If the transfer destination is a speaker compatible with multi-channel signals, the speaker can discard the downmixed signals, separate and reproduce the multi-channel signals (5.1 channel) included in the received signals.

Selecting Transfer Method

Next, description will be given of a process of selecting one transfer method from among the above three transfer methods including the amplitude modulation method, the bit expansion method, and the sampling frequency expansion method. The controller 48 (see FIG. 2) of the AV amplifier 13, for example, selects an appropriate transfer method based on: a "priority matter" when the music data D1 is transferred to audio equipment, such as the AV amplifier 14 and the TV 17; and a "processing capacity" of the audio equipment to which the music data D1 is transferred, the processing capacity being related to processing of the music data D1. It is of note that the controller 48 may select a transfer method based on either one of the priority matter or the processing capacity. The controller 48 may also select a transfer method based on the number of channels and/or content of the transferred music data D1, in place of, or in addition to, the priority matter and/or the processing capacity.

Figure 16:
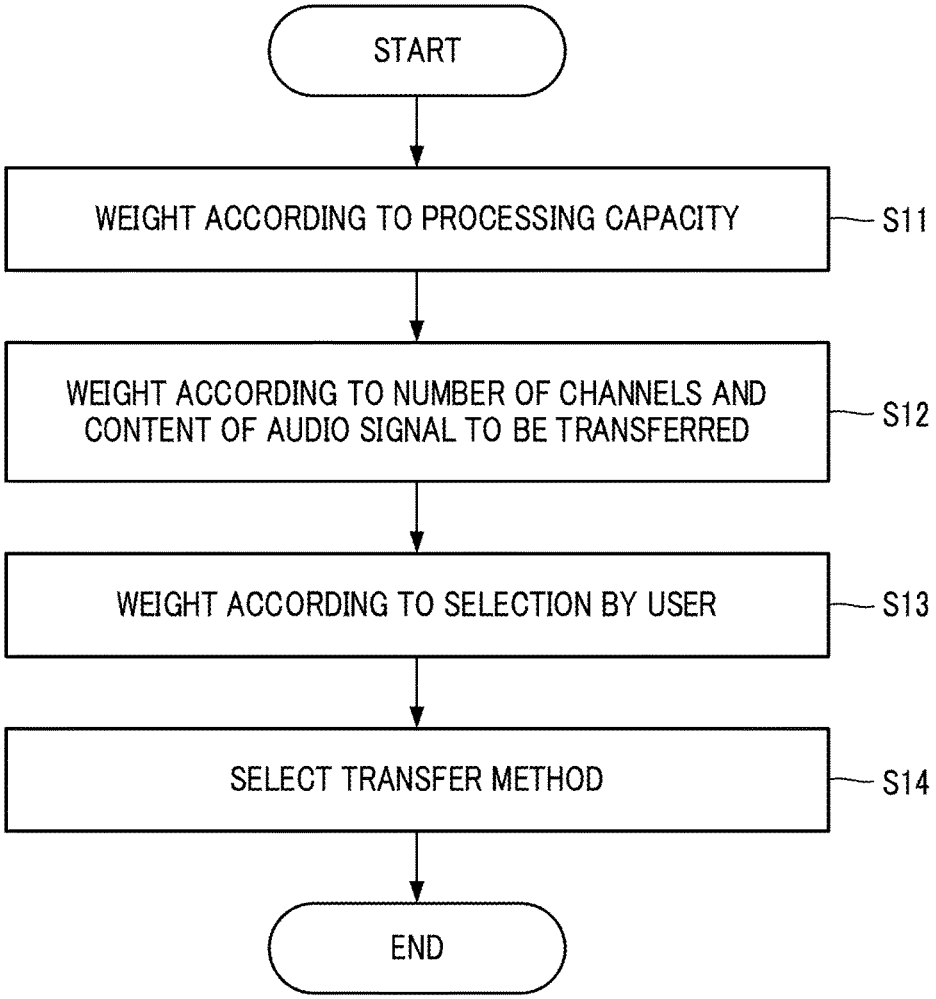
FIG. 16 is a flowchart showing a process of selecting a transfer method.
Figure 17:
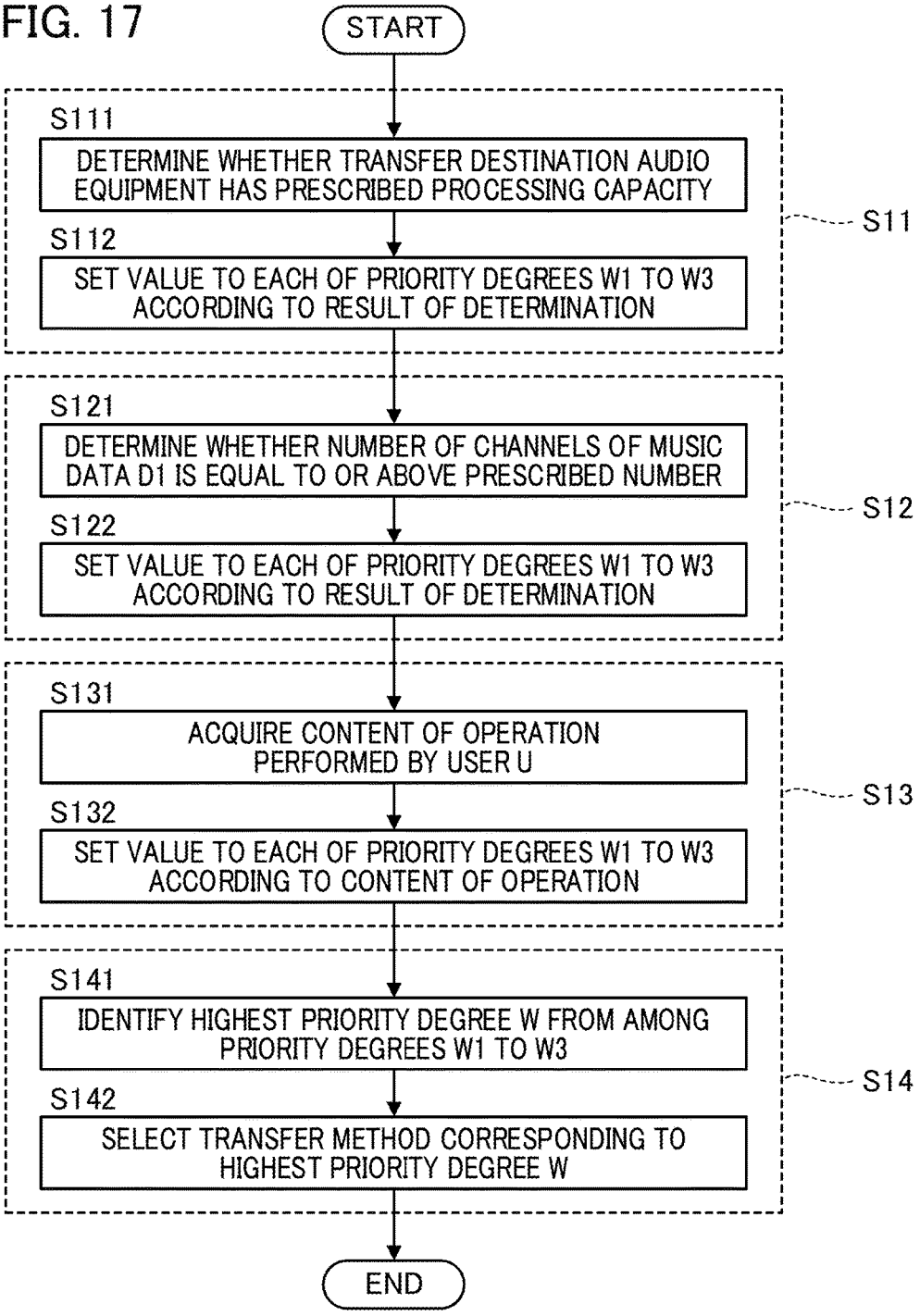
FIG. 17 is a flowchart showing a process of selecting a transfer method.

The controller 48, for example, when starting transfer of the music data D1, weights the transfer methods according to the flowchart shown in FIG. 16 (see S11 to S13 in FIG. 16), and selects a transfer method based on results of the weighting (see S14 in FIG. 16). At step S11, the controller 48 first weights the transfer methods in accordance with the processing capacity of the audio equipment at the transfer destination. At step S11, the controller 48 makes a determination on the processing capacity of the audio equipment at the transfer destination. The controller 48 may determine a processing capacity, for example, as a result of communicating with each piece of audio equipment via the network 19, or based on information input from the user U. The controller 48 does not have to directly acquire processing capacity information concerning the music data D1. For example, the controller 48 may acquire processing capacity information for a CPU of each piece of audio equipment, and based on the information, may estimate a processing capacity in relation to the music data D1. FIG. 17 is an example flowchart showing details of the flow in FIG. 16. In the present embodiment, as shown in the example in FIG. 17, the controller 48 at step S11 first acquires information about the processing capacity of the audio equipment to which the music data D1 is transferred (an example of the "capacity information"), and based on the obtained information, determines whether the audio equipment has a prescribed processing capacity (S111). Then, at step S11, the controller 48 sets a value for each of priority degrees W1 to W3 in accordance with a result of the determination made at step S111 (S112). The priority degree W1 is an evaluation value indicative of a degree of appropriateness of using the amplitude modulation method for transfer of the music data D1. The priority degree W2 is an evaluation value indicative of a degree of appropriateness of using the bit expansion method for transfer of the music data D1. The priority degree W3 is an evaluation value indicative of a degree of appropriateness of using the sampling frequency expansion method for transfer of the music data D1. In the description below, as an example, a piece of audio equipment is regarded as having a "prescribed processing capacity" if the audio equipment is capable of executing separation of channels. Hereafter, audio equipment having a prescribed processing capacity may on occasion be expressed as the "audio equipment having a high processing capacity", and audio equipment not having a prescribed processing capacity may on occasion be expressed as the "audio equipment having a low processing capacity".

For example, in a case that the processing capacity of the audio equipment to which the music data D1 is transferred is low (e.g., a case in which the audio equipment is a single speaker device), it is assumed that this audio equipment is incapable of executing separation of channels, which on the other hand is executable by the demodulation processor 67 (see FIG. 3). If separation of channels cannot be executed at the audio equipment at the transfer destination, valid transfer methods for transferring the music data D1 to the transfer destination audio equipment will be the amplitude modulation method and the bit expansion method by which signals can be reproduced as natural sounds even when the signals are reproduced without undergoing separation of channels. Thus, if the controller 48 determines that the processing capacity of the audio equipment at the transfer destination is low, the controller 48 increases the priority degree of the amplitude modulation method and the bit expansion method. Specifically, as shown in FIG. 17, when the result of the determination at step S111 is negative, the controller 48 sets a value w11 to the priority degree W1 for the amplitude modulation method, sets a value w21 to the priority degree W2 for the bit expansion method, and sets "0" to the priority degree W3 for the sampling frequency expansion method (the value w11 is a real number satisfying 0<w11 and the value w21 is a real number satisfying 0<w21).

Meanwhile, in a case that the processing capacity of the audio equipment to which the music data D1 is transferred is high, a valid transfer method will be the sampling frequency expansion method in which data loss during a signal generation process is the smallest and by which high sound quality can be maintained. Thus, if the controller 48 determines at step S11 that the processing capacity of the audio equipment at the transfer destination is high, the controller 48 increases the priority degree of the sampling frequency expansion method. Specifically, as shown in FIG. 17, when the result of the determination at step S111 is positive, the controller 48 sets "0" to the priority degree W1 for the amplitude modulation method, sets "0" to the priority degree W2 for the bit expansion method, and sets a value w31 to the priority degree W3 for the sampling frequency expansion method (the value w31 is a real number satisfying 0<w31). It is of note that even when the performance of the audio equipment at the transfer destination is high, signal transfer using the amplitude modulation method or the bit expansion method can also be executed. Thus, as an alternative, when the result of the determination at step S111 is positive, it is also possible to set a value w11 to the priority degree W1 for the amplitude modulation method, a value w21 to the priority degree W2 for the bit expansion method, and a value w31 to the priority degree W3 for the sampling frequency expansion method.

Next, at step S12, the controller 48 weights the transfer methods according to the number of channels of the music data D1 and/or the content of the music data D1. The controller 48 may detect the number of channels by, for example, directly detecting the number of channels of the music data D1 to be transferred, or based on, for example, input information from the user U. At step S12, the controller 48 increases the priority degree of, for example, the amplitude modulation method because high sound quality (sampling frequency) is not required for example, when the music data D1 is music content that consists of an LFE channel with a limited frequency band added to the basic two channels of front, such as a 2.1 channel, or when the music data D1 is music content that consists of a signal such as an announcement signal for a user (notification of mail reception) added to the basic two channels. For example, as shown in FIG. 17, at step S12, the controller 48 first determines for instance whether the number of channels of the music data D1 is equal to or greater than a prescribed number of channels (e.g., three channels) (S121), and then sets a value to each of the priority degrees W1 to W3 according to the result of the determination at step S121 (S122). More specifically, when the result of the determination at step S121 is negative, the controller 48 adds a value w12 to the priority degree W1 for the amplitude modulation method, adds "0" to the priority degree W2 for the bit expansion method, and adds "0" to the priority degree W3 for the sampling frequency expansion method (the value w12 is a real number satisfying 0<w12).

In a case that the music data D1 is three-channel or four-channel music content that consists of one or two channels with (a) full-frequency band(s) added to the basic two channels, the controller 48 increases the priority degree of, for example, the bit expansion method. In a case that the music data D1 is multi-channel, 5.1-channel or 7.1-channel music content that consists of three or more channels with full-frequency bands added to the basic two channels, the controller 48 increases the priority degree of, for example, the sampling frequency expansion method by which high-quality transfer is possible. Specifically, as shown in FIG. 17, when the result of the determination at step S121 is positive, the controller 48 adds "0" to the priority degree W1 for the amplitude modulation method, adds a value w22 to the priority degree W2 for the bit expansion method, and adds a value w32 to the priority degree W3 for the sampling frequency expansion method (the value w22 is a real number satisfying 0<w22 and the value w32 is a real number satisfying 0<w32). As described above, the controller 48 can select a transfer method according to the number of channels or signal content (sound quality or the like) of the music data D1. The above settings for priority degrees are mere examples. For example, the sampling frequency expansion method may be used for 2.1 channel as well.

Next, at step S13, the controller 48 weights the transfer methods according to a priority matter, namely content of operation performed by the user U through the remote controller of the AV amplifier 13 or the operation button provided on the AV amplifier 13. For example, by operating the remote controller, etc., the user U can select one from among 3 items (instructions); namely "reduce consumed power at the destination", "reduce latency among channels", and "prioritize high-resolution sound quality". Specifically, as shown in FIG. 17, the controller 48 at Step S13 first acquires the content of operation performed by the user U (S131), and then sets a value to each of the priority degrees W1 to W3 according to the content of operation performed by the user U, which was acquired at step S131 (S132).

According to the amplitude modulation method and the bit expansion method, the L channel audio signal and the R channel audio signal can be directly reproduced, and thus, if consumed power is to be suppressed, consumption of power required for the separation can be cut by canceling separation of channels at the audio equipment at the transfer destination and directly reproducing the audio signals. Thus, in a case that the user U selects "reduce consumed power at the transfer destination", the amplitude modulation method and the bit expansion method will be valid because execution or non-execution of the separation can be selected according to consumed power for those methods. Thus, in a case that "reduce consumed power at the transfer destination" is selected, the controller 48 raises the priority degree of the amplitude modulation method and the bit expansion method. Specifically, as shown in FIG. 17, in a case that the content of operation acquired at step S131 is "reduce consumed power at the destination", the controller 48 adds a value w13 to the priority degree W1 for the amplitude modulation method, adds a value w23 to the priority degree W2 for the bit expansion method, and adds "0" to the priority degree W3 for the sampling frequency expansion method (the value w13 is a real number satisfying 0<w13 and the value w23 is a real number satisfying 0<w23).

In a case that latency among channels is to be reduced, or more specifically, a user desires to output sound from neighboring speakers concurrently, the bit expansion method will be valid because sound output timings of channels can be relatively easily matched. Accordingly, in a case that the user U selects "reduce latency among channels", the controller 48 raises the priority degree of the bit expansion method. Specifically, as shown in FIG. 17, in a case that the content of operation acquired at step S131 is "reduce latency among channels", the controller 48 adds "0" to the priority degree W1 for the amplitude modulation method, adds a value w23 to the priority degree W2 for the bit expansion method, and adds "0" to the priority degree W3 for the sampling frequency expansion method.

In a case that the user U desires to place priority on sound quality, the sampling frequency expansion method will be valid because it enables more high-quality transfer. Accordingly, in a case that the user U selects "prioritize high-resolution sound quality", the controller 48 raises the priority degree of the sampling frequency expansion method. Specifically, as shown in FIG. 17, in a case that the content of operation acquired at step S131 is "prioritize high-resolution sound quality", the controller 48 adds "0" to the priority degree W1 for the amplitude modulation method, adds "0" to the priority degree W2 for the bit expansion method, and adds a value w33 to the priority degree W3 for the sampling frequency expansion method (the value w33 is a real number satisfying 0<w33). In the present embodiment, the values w11 to w33 added to the priority degrees W1 to W3 at steps S11 to S13 are assumed to be values equal to each other, e.g., "1".

Next, at step S14, the controller 48 selects a transfer method based on the results of weighting carried out at steps S11 to S13. Specifically, as shown in FIG. 17, the controller 48 at step S14 first identifies the highest priority degree W from among the priority degrees W1 to W3 (S141). Next, the controller 48 selects a transfer method that corresponds to the highest priority degree W identified at Step S141 (S142). More specifically, at step S142, the controller 48 selects the amplitude modulation method if the highest priority degree W identified at step S141 is the priority degree W1, selects the bit expansion method if the highest priority degree W identified at step S141 is the priority degree W2, and selects the sampling frequency expansion method if the highest priority degree W identified at step S141 is the priority degree W3. In a case that there are two or more highest priority degrees W among the priority degrees W1 to W3, the controller 48 may select one transfer method, for example, at random from among two or more transfer methods that correspond to the two or more highest priority degrees W. As described above, by selecting a transfer method from among the three transfer methods according to a priority matter and a processing capacity, the controller 48 can transfer the music data D1 using an appropriate method.

In the present embodiment, the AV amplifier 13 is an example of the "signal processing device". The AV amplifier 14 and the TV 17 are examples of the "reproduction device". The interface unit 47 is an example of the "transferrer". The controller 48 functions as the "selector" by executing a part or all of steps S11 to S14. The controller 48 functions as the "acquirer" by executing step S111. The music data D1 is an example of the "audio signal". The music data D2 and D3 are examples of the "transfer signal". The LFE channel audio signal and the metadata are examples of the "additional information". The interface unit 61 is an example of the "receiver". The demodulation processor 67 is an example of the "additional information acquirer". The L channel audio signal is an example of the "first signal". The R channel audio signal is an example of the "second signal".

According to the above embodiments, the following effects are attained. According to the amplitude modulation method and the bit expansion method, the signals can be reproduced as a natural sound even if the L channel audio signal and the R channel audio signal mixed with the LFE channel audio signal are directly output at transfer destination audio equipment (e.g., the TV 17) that is incompatible with a transfer method. In the network 19 in which the AV system 10 is applied, there may be audio equipment, such as the AV amplifier 14, provided with a rich DSP, but there may also be audio equipment, such as a single speaker device, simply designed to reproduce music data that has been received. In such a case, the above transfer methods do not require a high processing capacity from the audio equipment at the transfer destination and enable reproduction of the original 2-channel music with a simple process. Thus, between pieces of audio equipment that differ from one another in generation, performance, object, solution, etc., data having a mix of signals can be transferred appropriately within a limited audio frequency band.

Moreover, content of the processes of the three transfer methods described above are relatively easy compared to encoding for downmixing performed in conventional signal generation processes. Thus, even a piece of audio equipment incompatible with the transfer methods can be made compatible by, for example, simple firmware updating.

Modifications

The above embodiments may be modified in various manners. Specific modes of modification will be shown below as examples. Two or more modes freely selected from the examples below may be combined, as appropriate, in so far as the combination is workable. In the modifications shown below, elements with substantially the same actions or functions as those in the embodiments are denoted by the same reference symbols as in the above description and detailed description thereof will be omitted, as appropriate.

Modification 1

In the embodiments above, the values w11 to w33 added to the priority degrees W1 to W3 at steps S11 to S13 are equal values. However, the present invention is not limited to such a mode. For example, at steps S11 to S13, a part or all of the values w11 to w33 added to the priority degrees W1 to W3 may differ from one another. Furthermore, a degree of importance may be set in advance for each of steps S11 to S13 based on, for example, an operation by the user U, and the values w11 to w33 may be set according to the degrees of importance. For example, in a case that the degrees of importance of the steps are set as "degree of importance of step S11">"degree of importance of step S12">"degree of importance of step S13", the values w11 to w33 added to the priority degrees W1 to W3 in the steps may be set as "values added at step S11">"values added at step S12">"values added at step S13". In this case, the values w11 to w33 added to the priority degrees W1 to W3 at steps S11 to S13 may be set as "w11=w21=w31>w12=w22=w32>w13=w23=w33".

Modification 2

In the embodiments and the modification described above, the controller 48 selects a transfer method for the music data D1 for each piece of audio equipment to which the music data D1 is transferred. However, the present invention is not limited to such a mode. For example, in a case that there are a plurality of pieces of audio equipment to which the music data D1 is transferred, the controller 48 may select a transfer method for the music data D1 such that a single transfer method is applied to the plurality of pieces of audio equipment. In this case, the controller 48 for example may only have to determine at step S111 whether all of the plurality of pieces of audio equipment, to which the music data D1 is to be transferred, have a prescribed processing capacity. As another example, the controller 48 may instead select a transfer method for the music data D1 such that a single transfer method is applied to all pieces of audio equipment connected to the network 19. In this case, the controller 48 for example may only have to determine at step S111 whether all of the pieces of audio equipment connected to the network 19 have a prescribed processing capacity.

Modification 3

In the embodiments and modifications described above, the controller 48 selects a transfer method for the music data D1 according to a processing capacity of audio equipment. However, the present invention is not limited to such a mode. For example, the controller 48 may select a transfer method for the music data D1 in accordance with a processing capacity of the network 19, such as a transfer rate of the network 19, in place of or in addition to a processing capacity of audio equipment.

Modification 4

In the embodiments and modifications described above, the controller 48 executes steps S11 to S14 when selecting a transfer method for the music data D1. However, the present invention is not limited to such a mode. For example, when selecting a transfer method for the music data D1, the controller 48 may execute one step from among steps S11 to S13 and execute step S14 thereafter.

Modification 5

In the embodiments and modifications described above, an AV amplifier and a TV are shown as examples of audio equipment. However, the present invention is not limited to such a mode. Apart from an AV amplifier and a TV, employed as audio equipment may be an AV receiver, a personal computer (PC), a smartphone, an audio reproduction device, or other similar equipment.

Modification 6

In the embodiments and modifications described above, a low frequency LFE channel audio signal is added as additional information to each of the L channel audio signal and the R channel audio signal. However, the present invention is not limited to such a mode and the additional information may be a signal other than an LFE channel audio signal, for example a signal of a warning sound or the like. Moreover, while in the embodiments and the modifications described above the additional information is added to each of the L channel audio signal and the R channel audio signal, the present invention is not limited thereto. The additional information may be added to audio signals of, for example, the surround left (SL) channel and the center (C) channel. Furthermore, in the embodiments described above, the AV amplifier 13 may change the transfer method for each piece of audio equipment at the transfer destination. For example, the AV amplifier 13 may employ the amplitude modulation method for transfer to the TV 17, while employing the bit expansion method for transfer to the AV amplifier 14.

PREFERRED MODES OF THE PRESENT INVENTION

Preferred modes of the present invention derived from the above embodiments and modifications are described below as examples.

Mode 1

A signal processing device according to Mode 1 of the present invention includes: a selector configured to select one of a plurality of methods, in accordance with which a signal generation process is performed for generating a transfer signal in which additional information is added to an audio signal; a signal processor configured to execute the signal generation process of adding the additional information to the audio signal in accordance with the method selected by the selector; and a transferrer configured to transfer to a reproduction device the transfer signal generated by the signal processor. In this mode, in transferring an audio signal after adding additional information, from among a plurality of methods for a signal generation process (transfer method), an appropriate transfer method can be selected. Thus, a possibility is reduced of the audio signal being improperly reproduced by the reproduction device.

Mode 2

The signal processing device according to Mode 2 of the present invention incorporates the signal processing device according to Mode 1, and further includes: an acquirer configured to acquire processing capacity information that is information concerning a processing capacity of the reproduction device, and the selector selects the method for the signal generation process executed by the signal processor based on the processing capacity information acquired by the acquirer. In this mode, a transfer method that accords with a processing capacity of the reproduction device can be selected.

Mode 3

The signal processing device according to Mode 3 of the present invention incorporates the signal processing device according to Mode 1 or 2, in which the selector selects the method for the signal generation process executed by the signal processor based on a number of channels of the audio signal. In this mode, a transfer method that accords with the number of channels of the audio signal can be selected.

Mode 4

The signal processing device according to Mode 4 of the present invention incorporates the signal processing device according to any one of Modes 1 to 3, in which the additional information is a signal of a low frequency channel. In this mode, since a signal of a low frequency channel consists of low frequency components only, even when the additional information is directly reproduced without being modified, the additional information can be reproduced as a natural sound.

Mode 5

The signal processing device according to Mode 5 of the present invention incorporates the signal processing device according to any one of Modes 1 to 4, in which the additional information is a signal of a channel other than that of the audio signal. In this mode, signals of a plurality of channels can be transferred as transfer signals.

Mode 6

The signal processing device according to Mode 6 of the present invention incorporates the signal processing device according to any one of Modes 1 to 5, in which the signal processor includes an amplitude modulator configured to amplitude modulate a carrier signal by using the additional information and adding the amplitude modulated signal to the audio signal, the carrier signal either having a frequency within a frequency band barely audible to a human ear or having a frequency within a frequency band inaudible to the human ear. In this mode, the signal processor amplitude modulates the additional information, adds the modulated information to the audio signal, and transfers the resulting audio signal. The amplitude modulator uses the additional information to modulate a carrier signal at a frequency barely audible to a human ear (a carrier signal within a frequency band barely audible to the human ear) or a carrier signal within a frequency band inaudible to the human ear (a carrier at a frequency within a frequency band inaudible to the human ear). Accordingly, even when the added audio signal is directly reproduced at the destination reproduction device, the signal is perceived as a natural sound. For example, even in a case that a type or performance of various audio equipment existing in the network are unknown, use of this amplitude modulation method enables reproduction of natural sounds in audio equipment that is not capable of executing demodulation. Accordingly, a signal with a limited audio channel frequency band can be combined with a plurality of pieces of information and thus transferred. Also, in contrast to use of conventional encoding, by use of the present amplitude modulation method, a time can be shortened for accumulating signals before processing, the amount of accumulated signals in the destination reproduction device can be reduced, and a processing load also can be reduced with regard to an amount of memory used.

Mode 7

The signal processing device according to Mode 7 of the present invention incorporates the signal processing device according to Mode 6, in which the additional information is a signal of a low frequency channel, and the amplitude modulator downsamples the signal of a low frequency channel and amplitude modulates the carrier signal using the downsampled signal. The amplitude modulator mixes a signal of a low frequency channel into the audio signal and transfers the resulting signals. Since a signal of a low frequency channel consists of low frequency components only, the signal can be reproduced as a natural sound even when the sampling frequency is set to be low. Thus, the amplitude modulator performs amplitude modulation using sample values obtained by downsampling a low frequency signal, and can thereby combine a plurality of audio signals with a signal with a limited audio channel frequency band and transfer the resulting signals.

Mode 8

The signal processing device according to Mode 8 of the present invention incorporates the signal processing device according to Mode 6 or 7, in which in a case that the reproduction device does not have a prescribed processing capacity, the selector causes the amplitude modulator to generate the transfer signal. In this mode, even in a case that the reproduction device does not have a prescribed processing capacity and is unable, for example, to execute demodulation to separate an audio signal and a low frequency signal, the amplitude modulating method is selected as a transfer method. Accordingly, even if a mixed signal of an audio signal and a low frequency signal is directly reproduced, the signal can be reproduced as a natural sound.

Mode 9

The signal processing device according to Mode 9 of the present invention incorporates the signal processing device according to any one of Modes 1 to 8, in which the signal processor includes a bit expander configured to expand quantization bits of the audio signal and allocate the additional information to an expanded area of data acquired as a result of expansion. In this mode, it is possible to combine a plurality of pieces of information with a signal having a limited audio channel frequency band and transfer the information combined with the signal. In the bit expansion method, for example, audio signals of a plurality of channels can be included in a single packet transferred over the network, and moreover, the audio signals can be included in one same packet and transferred while the number of samples are matched between the audio signals. Thus, sound output timings of the channels can be matched easily.

Mode 10

The signal processing device according to Mode 10 of the present invention incorporates the signal processing device according to any one of Modes 1 to 9, in which the bit expander increases the expanded area by upsampling the audio signal. In this mode, a sampling frequency is increased to thereby increase the data amount to be acquired as an expanded area, with a result that a larger amount of additional information can be transferred together at one time.

Mode 11

The signal processing device according to Mode 11 of the present invention incorporates the signal processing device according to any one of Modes 1 to 10, in which the additional information is control data for adjusting a gain of the audio signal. In this mode, for example, by setting control data that causes an increase or decrease in the signal level of a specific channel among multiple channels included in an audio signal, a playback state of music at the destination can be modified according to a preference of a user.

Mode 12

The signal processing device according to Mode 12 of the present invention incorporates the signal processing device according to any one of Modes 1 to 11, in which the selector selects the method for the signal generation process executed by the signal processor based on at least one of content of operation by a user of the signal processing device and a processing capacity of the reproduction device. In this mode, from among a plurality of transfer methods, a transfer method suitable for content of operation of a user or a processing capacity of a reproduction device can be selected.

Mode 13

The signal processing device according to Mode 13 of the present invention incorporates the signal processing device according to Mode 12, in which the content of operation is an instruction to reduce consumed power for processing of the transfer signal at the reproduction device, an instruction to reduce latency in sound output based on the audio signal at the reproduction device, or an instruction to improve sound quality in reproducing the audio signal at the reproduction device. In this mode, from among a plurality of transfer methods, a transfer method can be selected that enables reduction in consumed power at a reproduction device, reduction in latency in sound output at the reproduction device, or improvement in sound quality at the reproduction device.

Mode 14

An audio signal transfer method according to Mode 14 of the present invention includes: selecting, from among a plurality of methods, a method for a signal generation process for generating a transfer signal by adding additional information to an audio signal; generating the transfer signal by a signal generation process in accordance with the selected method; and transferring the generated transfer signal to a reproduction device. In this mode, in transferring an audio signal after adding additional information, an appropriate method for a signal generation process (transfer method) can be selected from among a plurality of transfer methods.

In preferred modes, the audio signal transfer method according to Mode 14 may include executing various processes as set forth in the above Modes 2 to 13 of the signal processing device.

Mode 15

A signal processing system according to Mode 15 of the present invention includes a signal processing device and a reproduction device, and the signal processing device includes: a selector configured to select one of a plurality of methods, in accordance with which a signal generation process is performed for generating a transfer signal in which additional information is added to an audio signal; a signal processor configured to execute the signal generation process of adding the additional information to the audio signal in accordance with the method selected by the selector; and a transferrer configured to transfer to a reproduction device the transfer signal generated by the signal processor. In this mode, upon transferring an audio signal after adding additional information, an appropriate method for a signal generation process (transfer method) can be selected from among a plurality of transfer methods.

Mode 16

A transfer method according to Mode 16 of the present invention includes: expanding quantization bits of an audio signal; setting additional information for an expanded area of data acquired as a result of expansion; and transferring a transfer signal in which the additional information is added to the audio signal. In this mode, additional information is transferred by being included in the area in which quantization bits are expanded. Accordingly, it is possible to combine a plurality of pieces of information in a signal having a limited audio channel frequency band and transfer the information combined with the signal. Moreover, in the present transfer method, for example, audio signals having a plurality of channels can be included in a single packet for transfer over a network, and moreover, the audio signals can be included in one same packet and transferred while the number of samples are matched between the audio signals. Thus, sound output timings of the channels can be matched easily.

Mode 17

The transfer method according to Mode 17 of the present invention incorporates the transfer method according to Mode 16, in which the expanding includes upsampling the audio signal and increasing the expanded area. In this mode, a sampling frequency is raised to increase the data amount that can be acquired as an expanded area, and as a result, a larger amount of additional information can be transferred together at one time.

Mode 18

The transfer method according to Mode 18 of the present invention incorporates the transfer method according to Mode 16 or 17, in which the audio signal includes audio signals of a plurality of channels, and the setting includes setting the additional information by dividedly allocating the additional information to expanded areas that correspond to the respective audio signals of the plurality of channels. In this mode, for example, additional information (audio signal) for one channel can be dividedly allocated to expanded areas of a plurality of channels and thus transferred. Accordingly, if additional information cannot be transferred in a single expanded area, the additional information can be dividedly allocated to expanded areas of the respective channels and thus transferred efficiently.

Mode 19

A reproduction device according to Mode 19 of the present invention is a reproduction device that reproduces the audio signal transferred using the transfer method according to any one of Modes 16 to 18, the device including: an additional information acquirer configured to acquire the additional information from the transfer signal in which the additional information is added to the audio signal; and an outputter configured to output the additional information acquired by the additional information acquirer. In this mode, the audio signal can be reproduced in parallel with output of the additional information included in the expanded area obtained by expanding quantization bits. Moreover, in a case that the additional information is another audio signal, an audio signal and the additional information (the other audio signal) transferred together can be reproduced together.

Mode 20

A reproduction device according to Mode 20 of the present invention is a reproduction device that reproduces the audio signal transferred using the transfer method according to any one of Modes 16 to 18, the device including: an nullifier configured to nullify the additional information within the transfer signal in which the additional information is added to the audio signal; and a reproducer configured to reproduce the audio signal after the nullification. In this mode, by nullifying (e.g., zero-clearing) the additional information in the expanded area, the audio signal alone can be reproduced if the equipment is not compatible with output (e.g., a reproduction process) of the additional information in the expanded area.

Mode 21

A transfer method according to Mode 21 of the present invention includes: amplitude modulating a carrier signal by using additional information, the carrier signal having either a frequency in a frequency band within an audible frequency band that is barely audible to a human ear or a frequency in an inaudible frequency band; adding the amplitude modulated signal to an audio signal to generate a transfer signal; and transferring the transfer signal. In this mode, the carrier signal is amplitude modulated using the additional information, the amplitude modulated signal is added to the audio signal, and the resulting signal is transferred. In the amplitude modulating, a carrier signal that has a frequency barely audible or inaudible to the human ear is modulated using the additional information. Thus, even when the added audio signal is directly reproduced at the transfer destination, the signal is perceived as a natural sound. For example, if a type or a capacity of audio equipment in the network is unknown, the use of the transfer method also enables reproduction of natural sounds in audio equipment in which demodulation cannot be executed. Furthermore, a signal with a limited audio channel frequency band can be combined with a plurality of pieces of information and thus transferred. Moreover, a processing load involved in the present amplitude modulating method is smaller than a processing load involved in encoding for downmixing performed in a conventional transfer processes. Further, in contrast to conventional encoding, by use of the present amplitude modulating method, a time required to accumulate signals and an amount of accumulated signals before processing at transfer destination audio equipment can be reduced, and still further a processing load also can be reduced with regard to an amount of memory used.

Mode 22

The transfer method according to Mode 22 of the present invention incorporates the transfer method according to Mode 21, in which the additional information is a signal of a low frequency channel, the method further including downsampling the signal of a low frequency channel. Since a signal of a low frequency channel consists of low frequency components only, the signal can be reproduced as a natural sound even when the sampling frequency is set to be low. In this mode, by execution of amplitude modulation using sample values obtained by downsampling the signal of a low frequency channel, it is possible to transfer a plurality of audio signals with a signal combined with a limited audio channel frequency band signal.

Mode 23

The transfer method according to Mode 23 of the present invention incorporates the transfer method according to Mode 21 or 22, in which the audio signal includes a first signal and a second signal, and the adding includes adding the amplitude modulated signal to the first signal and adding reversed-phase components of the amplitude modulated signal to the second signal, the method further including calculating a difference between the first signal and the second signal at the transfer destination. In this mode, by calculating a difference between the first signal and the second signal at the transfer destination, in-phase components of the first and second signals can be removed. Moreover, regarding the amplitude modulated signal added in-phase to the first signal and added reversed-phase to the second signal, the amplitude modulated signal extracted by calculating a difference between the first signal and the second signal has an amplitude double that of the original amplitude modulated signal. Thus, a sound-to-noise ratio (S/N ratio) is increased and noise can be reduced.

Mode 24

The transfer method according to Mode 24 of the present invention incorporates the transfer method according to Mode 23, the method further including calculating a moving average value for the additional information extracted in the calculating of the difference. In this mode, by calculating a moving average value for the additional information extracted in the calculation of a difference, components of an audio signal included in the additional information for which differences between two adjacent samples are small can be made to cancel each other out. Description of Reference Signs

10: AV system
13: AV amplifier
33, 35, 39: speakers
40: signal processor
47: interface unit
43: amplitude modulator
44: bit expander
45: frequency expander
48: controller
D1, D2, D3: music data

What is claimed is:

1. A signal processing device comprising:

a selector configured to select one of a plurality of methods, in accordance with which a signal generation process is performed for generating a transfer signal in which additional information is added to an audio signal;

a signal processor configured to execute the signal generation process of adding the additional information to the audio signal in accordance with the method selected by the selector; and a transferrer configured to transfer to a reproduction device the transfer signal generated by the signal processor.

2. The signal processing device according to claim 1, further comprising:

an acquirer configured to acquire processing capacity information concerning a processing capacity of the reproduction device, wherein the selector selects the method for the signal generation process executed by the signal processor based on the processing capacity information acquired by the acquirer.

3. The signal processing device according to claim 1, wherein the selector selects the method for the signal generation process executed by the signal processor based on a number of channels of the audio signal.

4. The signal processing device according to claim 1, wherein the additional information is a signal of a low frequency channel.

5. The signal processing device according to claim 1, wherein the additional information is a signal of a channel other than a channel of the audio signal.

6. The signal processing device according to claim 1, wherein the signal processor includes an amplitude modulator configured to amplitude modulate a carrier signal by using the additional information and add the amplitude modulated signal to the audio signal, the carrier signal either having a frequency within a frequency band barely audible to a human ear or having a frequency within a frequency band inaudible to the human ear.

7. The signal processing device according to claim 6, wherein the additional information is a signal of a low frequency channel, and the amplitude modulator downsamples the signal of a low frequency channel and amplitude modulates the carrier signal using the downsampled signal.

8. The signal processing device according to claim 6, wherein in a case that the reproduction device does not have a prescribed processing capacity, the selector causes the amplitude modulator to generate the transfer signal.

9. The signal processing device according to claim 1, wherein the signal processor includes a bit expander configured to expand quantization bits of the audio signal and allocate the additional information to an expanded area of data acquired as a result of expansion.

10. The signal processing device according to claim 9, wherein the bit expander increases the expanded area by upsampling the audio signal.

11. The signal processing device according to claim 1, wherein the additional information is control data for adjusting a gain of the audio signal.

12. The signal processing device according to claim 1, wherein the selector selects the method for the signal generation process executed by the signal processor, based on at least one of content of operation by a user of the signal processing device and a processing capacity of the reproduction device.

13. The signal processing device according to claim 12, wherein the content of operation is an instruction to reduce power consumed for processing of the transfer signal at the reproduction device, an instruction to reduce latency in sound output based on the audio signal at the reproduction device, or an instruction to improve sound quality when the audio signal is reproduced at the reproduction device.

14. An audio signal transfer method comprising:

selecting, from among a plurality of methods, a method for a signal generation process for generating a transfer signal by adding additional information to an audio signal;

generating the transfer signal by a signal generation process in accordance with the selected method; and transferring the generated transfer signal to a reproduction device.

15. The audio signal transfer method according to claim 14, further comprising:

acquiring processing capacity information concerning a processing capacity of the reproduction device, wherein the selecting of the method for the signal generation process includes selecting the method based on the acquired processing capacity information.

16. The audio signal transfer method according to claim 14, wherein the selecting of the method for the signal generation process includes selecting the method based on a number of channels of the audio signal.

17. The audio signal transfer method according to claim 14, wherein the additional information is a signal of a low frequency channel.

18. The audio signal transfer method according to claim 14, wherein the additional information is a signal of a channel other than a channel of the audio signal.

19. The audio signal transfer method according to claim 14, wherein one of the plurality of methods for the signal generation process includes amplitude modulating a carrier signal by using the additional information and adding the amplitude modulated signal to the audio signal, the carrier signal either having a frequency within a frequency band barely audible to a human ear or having a frequency within a frequency band inaudible to the human ear.

20. A signal processing system comprising a signal processing device and a reproduction device, wherein the signal processing device includes:

a selector configured to select one of a plurality of methods, in accordance with which a signal generation process is performed for generating a transfer signal in which additional information is added to an audio signal;

a signal processor configured to execute the signal generation process of adding the additional information to the audio signal in accordance with the method selected by the selector; and a transferrer configured to transfer to a reproduction device the transfer signal generated by the signal processor.

* * * * *